US006223777B1

(12) United States Patent
Smith et al.

(10) Patent No.: US 6,223,777 B1
(45) Date of Patent: May 1, 2001

(54) REPOSITIONABLE, FLEXIBLE, AND EXTENDIBLE CONNECTOR

(75) Inventors: Jeffrey E. Smith, Alpharetta, GA (US); Christopher D. Noble, Mooresville, NC (US)

(73) Assignee: Gutter World, Inc., Altanta, GA (US)

( * ) Notice: Subject to any disclaimer, the term of this patent is extended or adjusted under 35 U.S.C. 154(b) by 0 days.

(21) Appl. No.: 09/420,285

(22) Filed: Oct. 18, 1999

Related U.S. Application Data

(63) Continuation-in-part of application No. 09/007,932, filed on Jan. 16, 1998, now Pat. No. 6,041,825, which is a continuation-in-part of application No. 08/610,588, filed on Mar. 7, 1996, now Pat. No. 5,813,701.

(51) Int. Cl.[7] ..... F16L 11/11

(52) U.S. Cl. ..... 138/109; 138/119; 138/121; 138/DIG. 11; 138/DIG. 8; 285/226; 52/16

(58) Field of Search ..... 138/109, 119, 138/121, DIG. 8, DIG. 11; 285/226, 236, 237; 239/197, 208, 269; 56/16; 137/615

(56) References Cited

U.S. PATENT DOCUMENTS

| | | | |
|---|---|---|---|
| D. 206,236 | | 11/1966 | Seckel . |
| 2,814,529 | | 11/1957 | Arnt . |
| 3,076,669 | | 2/1963 | Schlein . |
| 3,259,405 | * | 7/1966 | Heller ..... 138/121 |
| 3,336,950 | | 8/1967 | Fochler . |
| 3,349,805 | | 10/1967 | Fried . |
| 3,623,500 | | 11/1971 | Hoy . |
| 3,695,643 | | 10/1972 | Schmunk . |
| 3,825,288 | | 7/1974 | Maroschak . |
| 3,838,713 | | 10/1974 | Tubbs . |
| 3,861,419 | | 1/1975 | Johnson . |
| 3,873,137 | | 3/1975 | Yamaguchi . |
| 3,911,954 | | 10/1975 | Johnson . |
| 3,929,165 | | 12/1975 | Diebolt et al. . |
| 3,958,425 | | 5/1976 | Maroschak . |
| 3,966,121 | | 6/1976 | Littman . |
| 4,360,104 | | 11/1982 | Lang . |
| 4,593,690 | | 6/1986 | Sheridan et al. . |
| 4,650,224 | | 3/1987 | Smith . |
| 4,810,008 | | 3/1989 | Brodie . |
| 4,953,897 | | 9/1990 | Klöber . |
| 5,165,732 | * | 11/1992 | Townsend ..... 285/226 |
| 5,311,753 | | 5/1994 | Kanao . |
| 5,358,006 | | 10/1994 | Sweers . |
| 5,375,891 | | 12/1994 | Sicotte et al. . |
| 5,395,278 | | 3/1995 | Dickhut . |
| 5,507,319 | | 4/1996 | Kanao . |
| 5,511,829 | | 4/1996 | Sicotte et al. . |

(List continued on next page.)

FOREIGN PATENT DOCUMENTS

| | | |
|---|---|---|
| 1238172 | 6/1988 | (CA) . |
| 426-180 | 6/1965 | (CH) . |
| 1247652 | 10/1960 | (FR) . |
| 1584365 | 7/1976 | (GB) . |
| 1559645 | 9/1977 | (GB) . |
| 52-43126 | 4/1977 | (JP) . |
| 54-6126 | 1/1979 | (JP) . |

*Primary Examiner*—James Hook
(74) *Attorney, Agent, or Firm*—Morris, Manning & Martin

(57) ABSTRACT

An integrally molded, repositionable connector has a collapsible obround body that includes lockable annular members that allow the body portion to extend, compress, bend, and lock into selectable lengths and angular positions. Each lockable annular member includes a static side, a movable side, and a reinforcing bead. Each annular member also has a plurality of arcuate segments defining the obround body. The connector can be extended by manually pulling the movable sides away from the static sides until the movable sides lock into position. The connector can also be compressed by pushing the movable sides towards the static sides until the movable sides lock into position.

51 Claims, 18 Drawing Sheets

U.S. PATENT DOCUMENTS 5,607,107 * 3/1997 Grieve et al. ..... 138/119
5,704,401 1/1998 Fukui et al. .
5,813,701 * 9/1998 Noble ..... 138/119
5,915,735 * 6/1999 Noble ..... 138/119
6,021,816 * 2/2000 Jeltsch et al. ..... 138/121
6,041,825 * 3/2000 Smith et al. ..... 138/119

* cited by examiner

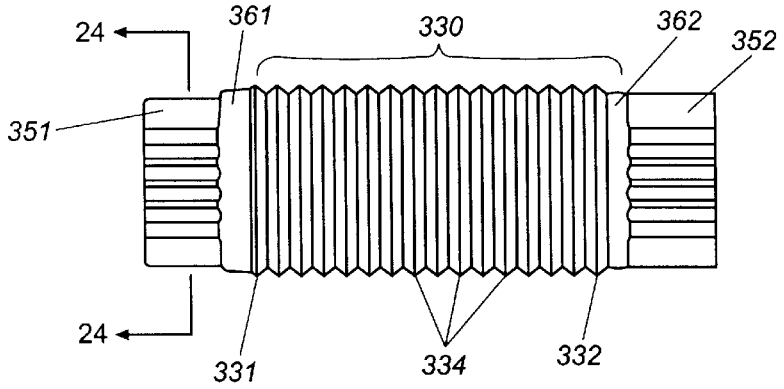
Fig. 19
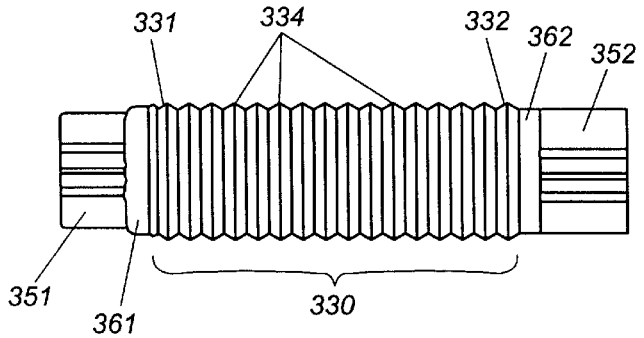
Fig. 20
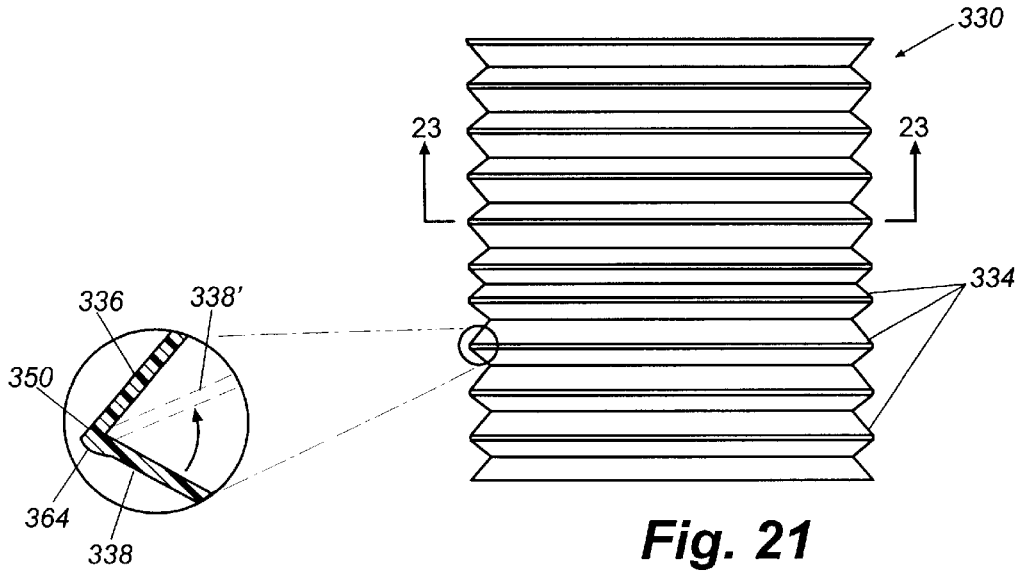
Fig. 21
Fig. 22

REPOSITIONABLE, FLEXIBLE, AND EXTENDIBLE CONNECTOR

CROSS REFERENCE TO RELATED APPLICATION

This application is a continuation-in-part of application Ser. No. 09/007,932 filed Jan. 16, 1998 now U.S. Pat. No. 6,041,825, which is a continuation-in-part of application Ser. No. 08/610,588 filed Mar. 7, 1996, now U.S. Pat. No. 5,813,701.

FIELD OF THE INVENTION

The present invention relates to gutters and gutter downspouts, and in particular relates to a connector particularly designed to attach to a downspout to provide a flexible, extendible, interlocking channel for funneling rainwater with an obround or generally rectangular cross section.

BACKGROUND OF THE INVENTION

For many years, buildings have been equipped with gutters and downspouts for removing water from roofs and away from foundations. Typically, the gutters of a building are connected to a number of downspouts. The gutters are designed so that water does not collect in any one place in the gutters. The gutters are usually at a slight decline in the direction of the downspouts so that the force of gravity will cause the rainwater to travel down the decline, through the downspout and exit the opening of the downspout.

Fixed angle elbow connectors are typically utilized for connecting gutters and portions of downspouts together. It is desirable to have the downspout supported close to or against the side of the building. Typical elbow connectors are fastened between the gutter and the downspout so that the downspout may be routed from its junction with the gutter back underneath the overhang of the roof or soffit and extend adjacent the overhang at a slight decline. A second fixed angle elbow connector is typically utilized between the portion of the downspout extending adjacent the overhang and the remaining portion of the downspout which extends downward along the side of the building. A third fixed angle elbow connector is typically utilized at the lower end of the downspout portion extending down the side of the building and exhaust the rainwater along the ground away from the side of the building.

One problem with known gutter systems is that fixed angle elbow connectors are manufactured with a fixed degree of bend, and are a fixed length. However, when the overhang of a roof is large or not uniform, custom elbow connectors are required. Therefore, installing a gutter system requires measurements and calculations and custom-cutting of the downspouts and elbows so that the gutter and downspout may be properly supported close to the side of the building.

Another problem of known gutter systems is that the known elbow connector typically provided at the downspout end which is adjacent the ground only directs water a short distance away from the building. Because of this short distance, water is often exhausted too close to the foundation of the building and causes the foundation to crack or leak. Although another piece of downspout extending on the ground away from the building can be connected to the elbow to exhaust the water further away from the building, adding another piece of downspout has several drawbacks. One drawback is that the downspout portion can only be extended in the same linear direction of the elbow of the downspout because downspout material is not flexible or bendable. Another drawback is that an extension of downspout may have to be moved for lawn care or other reasons and the downspout extension is inconvenient to uncouple and move.

Attempts have been made in the art to provide a downspout extension connector that directs water away from a building without simply adding another piece of downspout material. One example of these attempts is the bendable, "corrugated" plastic pipe and adapters that are connected to a downspout and buried in the ground to channel water away from the building. Other examples are described in the patents to Sweers (U.S. Pat. No. 5,358,006), Schlein (U.S. Pat. No. 3,076,669), Johnson (U.S. Pat. No. 3,861,419), and in Japanese Kokai No. 52-43126.

Bendable, corrugated plastic pipes and adapters, such as supplied by Advanced Drainage Systems, Inc. of Montezuma, Ga., are known in the art. The adapter is connected to the downspout and then the bendable corrugated plastic pipe is connected to the adapter. Although these corrugated plastic pipes direct water away from the foundation of a building, they suffer from several drawbacks. One drawback of these corrugated plastic pipes is that, although bendable, they will not hold their position. Thus, elbows are required when the user needs a turn in the pipe, or a bent trench must be dug to guide and hold the pipe.

Another drawback of the corrugated plastic pipe is the number of parts required. Corrugated, plastic pipes with circular cross-sections require an adapter piece to connect to the rectangular cross-sectional downspout and elbows where a turn in the extension is needed. Another drawback of these corrugated, plastic pipe downspout extensions is their fixed length. The user may need a downspout extension of a greater or lesser length than the fixed length provided.

Sweers, U.S. Pat. No. 5,358,006, describes an adjustable extension assembly for a downspout that includes a fixed piece attachable to the lowermost end of a downspout, a rotatable collar attached to the fixed piece, and at least one extension pivotably attached to the rotatable collar. The assembly described by Sweers can be pointed in different directions and the assembly can be extended to different lengths. However, one of the drawbacks of Sweers is that the assembly can point only linearly and can not bend around objects.

Johnson, U.S. Pat. No. 3,861,419, describes a hinged extension for downspouts. The hinge allows the downspout extension to be selectively disengaged from the downspout so that the extension can be pivoted to provide clearance for routine yard work. However, the hinged extension described by Johnson is not bendable or flexible and only points in the same direction as the downspout.

Attempts have also been made in the art to provide a gutter elbow. One example is described in the patent to Schlein (U.S. Pat. No. 3,076,669). Schlein, U.S. Pat. No. 3,076,669, describes a plastic bellows elbow with spigot and socket ends. The device is configured for connecting an eaves trough to a downspout. The elbow comprises plastic having limited flexibility and a tendency to cold flow to a predetermined set under sustained pressure and having an elastic memory. The intermediate portion of the coupling is described as being provided with a "bellows formation" that provides a certain degree of flexibility, allowing it to be bent in any direction and expand and contract. However, the bellows in Schlein will not hold its position and it is of circular cross section. Japanese Kokai No. 52-43126 describes a plastic elbow for a rain trough, characterized by the fact that it is composed by joining the rain trough inserting part and a rain trough receiving part as one body to two ends of a bellows part capable of elongating and bending, in which certain umbrella-shaped parts and annular flexing parts are joined alternately. However, there is no indication that this device is capable of locking into and holding a position. Besides, the arrangement shown in this document is of circular cross section, which does not readily adapt to gutters and downspouts commonly found in the United States, which have generally rectangular cross sections.

The Japanese Kokai document shows an elbow having a circular cross section. Aesthetically, a rainwater connector such as an elbow or downspout extension should be of a similar cross section to that of the downspouts and other components, which in the United States is generally rectangular. Prior to the present invention, it has not been possible to make a connector that is of a generally rectangular or obround cross section that is extendible and locks into position.

Accordingly, the prior art does not satisfy the need for a connector that is inexpensive, flexible, extendible, locks into place, holds its position, requires few parts, and is interlocking, and has a generally rectangular or obround cross section. The needs outlined above led to the present invention.

SUMMARY OF THE PRESENT INVENTION

The present invention seeks to provide a connector that is inexpensive, flexible, extendible, locks into place, holds its position, is unitary, and is interlocking to form a downspout assembly. Moreover, the cross section of the connector is obround, thereby providing a generally rectangular appearance that is more compatible with existing gutters and downspouts.

Briefly described, the present invention provides an integrally molded, repositionable connector for connection to a rectangular cross-sectional end of a gutter, a downspout, or the like. The connector of the present invention may be utilized as either a downspout extension connector for exhausting water further away from the building or as an elbow connector for connecting gutters and portions of downspouts together. The body portion is obround, yet still defines corrugations that are flexible, extend, contract, and lock into position, so that the connector may be configured into any angular position and hold its position as described below.

The body portion includes a plurality of collapsible corrugations. The collapsible corrugations have lockable annular members that allow the body portion to extend, compress, bend, and lock into selectable lengths and angular positions. The connector further includes end cuffs or connector portions coupled at the ends of the body portion. The cuffs or end connector portions are preferably generally rectangular in cross-section so that the connector can readily be connected to the end of the gutter, downspout, or the like.

More particularly described, each lockable annular member of the present invention includes a frustoconical static side and a frustoconical movable side, and a reinforcing bead extending circumferentially about the apex of the junction between the static and movable sides. The connector can be extended by manually pulling the movable sides away from the static sides until the movable sides lock into an extended position. The connector can be compressed by pushing the movable sides towards the static sides until the movable sides lock into a nested, compressed position.

Therefore, it is an object of the present invention to provide a connector that is flexible, extendible, locks into place, and holds its position, yet has a generally rectangular outward appearance.

It is a further object of the present invention to provide such a device that is inexpensive and provides a unitary structure.

It is a further object of the present invention to provide such devices that will interlock to form a downspout assembly.

Other features and advantages of the present invention will be apparent to persons skilled in the art from the following detailed description of a preferred embodiment accompanied by the attached drawings wherein identical reference numerals will refer to like parts in the various views.

BRIEF DESCRIPTION OF THE DRAWINGS

FIG. 19 is a top view of the elbow connector of the FIG. 13 embodiment.

FIG. 20 is a side view of the elbow connector of the FIG. 13 embodiment.

FIG. 21 illustrates the collapsible corrugations in the body portion of an elbow connector of the FIG. 13 embodiment.

FIG. 22 is an enlarged view of a collapsible corrugation of FIG. 21.

DETAILED DESCRIPTION

The various embodiments of the present invention described herein are a plastic connector that satisfies the need for an apparatus that is inexpensive, flexible, extendible, locks into place, holds its position, has a unitary structure, has an obround cross section, and is interlocking with gutters or downspouts to form a downspout assembly. A connector in accordance with the preferred embodiments of the present invention is extendible and collapsible to different lengths and flexible to different positions.

As used herein, the term "obround" means a closed figure having at least two generally parallel or curved sides and generally semicircular ends, quarter rounded ends, or curved corners. Stated in other words, obround as used herein means having periphery segments with rounded intersections. The periphery segments on adjacent sides have unequal lengths; but the periphery segments which oppose one another are generally parallel and are of equal length. The term is thus intended to encompass closed figures having generally parallel opposite sides with rounded corners, generally elliptical closed figures, and generally rectangular closed figures having rounded corners, for example quarter rounded corners. Accordingly, the term obround is meant to be interpreted broadly to cover figures having cross sections that are generally rectangular, generally elliptical, or generally obround, but have rounded corners that facilitate locking, extendible, flexible corrugations constructed as described herein.

Figure 1:
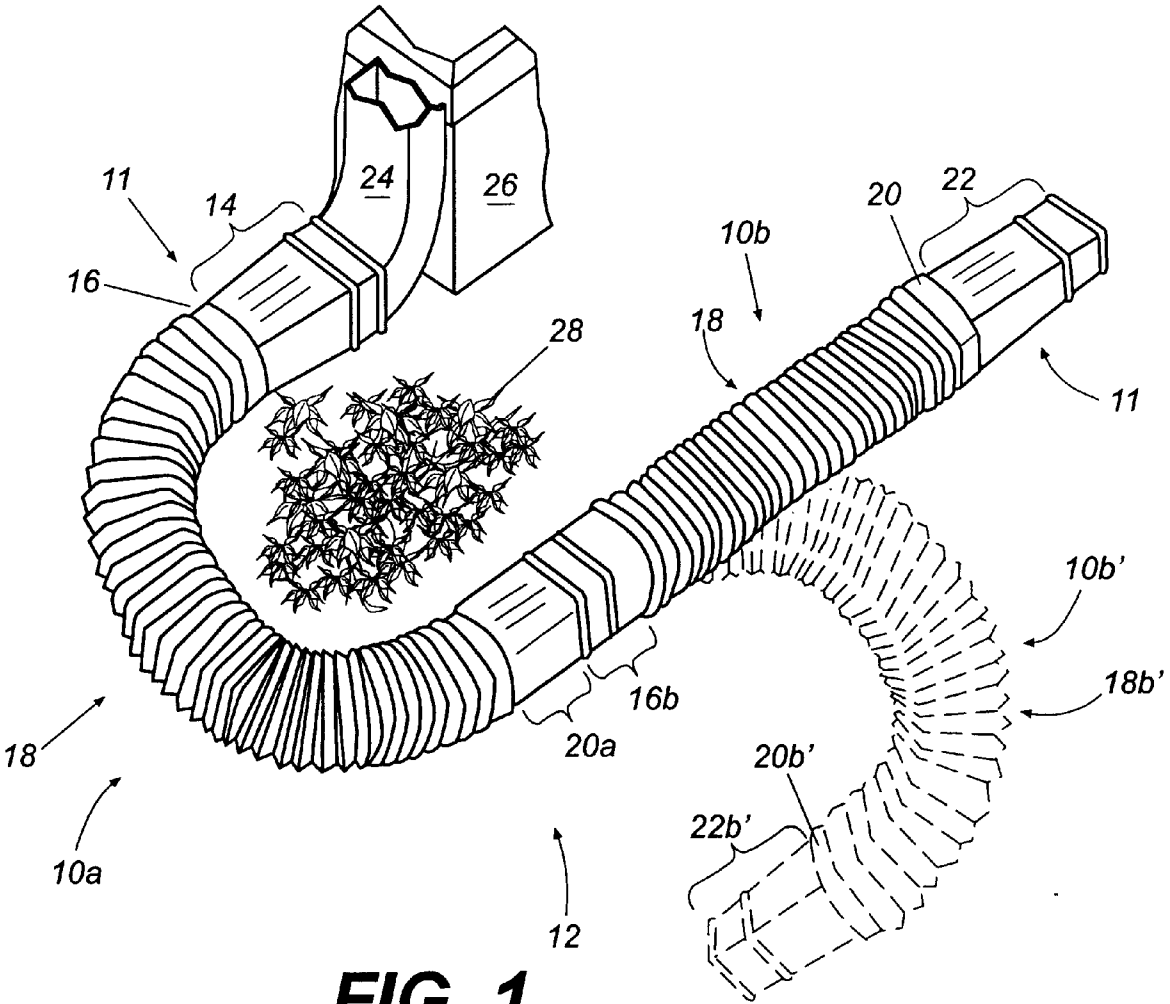
FIG. 1 is a perspective view of two interlocked repositionable flexible downspout extension connectors constructed in accordance with one aspect of the present invention, attached to the downspout of a building.

As shown in FIG. 1, the first embodiment is an obround plastic downspout extension connector 10 that is connected to the end of a downspout to exhaust water away from the foundation of a building. A number of downspout extension connectors, 10*a*, 10*b*, can be coupled together to form a downspout extension assembly. A downspout extension connector constructed in accordance with this aspect of the present invention is shown in FIGS. 1–12.

Other embodiments of the present invention include obround downspout extension connectors 100 and 200 shown in FIGS. 11 and 12, and obround repositionable elbow-like connector 300 shown in FIGS. 13–27. The elbow connector is utilized for connecting gutters and portions of downspouts together. Both the downspout extension connector and the elbow connector have an obround body portion as described below.

Referring further to the drawings, in which like numerals refer to like elements throughout the several views, FIG. 1 shows a pair of downspout extension connectors 10*a* and 10*b* in accordance with one aspect of the present invention. Each downspout extension connector 10*a* and 10*b* has an elongate, obround body portion 18, commonly referred to as an adjustable portion 18. The connectors also include outer, generally rectangular cuffs 11 that couple to gutters or downspouts, or to like cuffs on other connectors for extending the length of a connector assembly, e.g. assembly 12. In the embodiment of FIG. 1, the cuffs 11 of the downspout connectors 10*a* and 10*b* each further include a first selectively removable adapter portion 14, a first interlockable end connector portion 16, a second interlockable end connector portion 20, and a second selectively removable adapter portion 22.

The second selectively removable adapter portion 22*a* of downspout extension connector 10*a* and the first selectively removable adapter portion 14*b* of downspout extension connector 10*b* are not shown in FIG. 1 because they have been removed so that the downspout extension connectors 10*a* and 10*b* could be coupled together to form extension assembly 12. Removal of the selectively removable adapter portions 14*b* and 22*a* and the connection of downspout extension connectors 10*a* and 10*b* will be more fully described in reference to FIG. 10.

Still referring to FIG. 1, the downspout extension assembly 12 functions as follows. The first selectively removable adapter portion 14*a* of downspout extension connector 10*a* is connected to downspout 24 of building 26. Rainwater from the roof of building 26 flows down downspout 24, then flows through the downspout extension connectors 10*a* and 10*b* and out the end of second selectively removable adapter portion 22*b*. Downspout extension connector 10*a* is shown in FIG. 1 bent around bush 28 to demonstrate the flexibility of a downspout extension connector. A dashed-lined downspout extension connector 10*b*' is also shown in FIG. 1 to further demonstrate that downspout extension connector 10*b* is flexible and can be locked into different positions.

Figure 2:
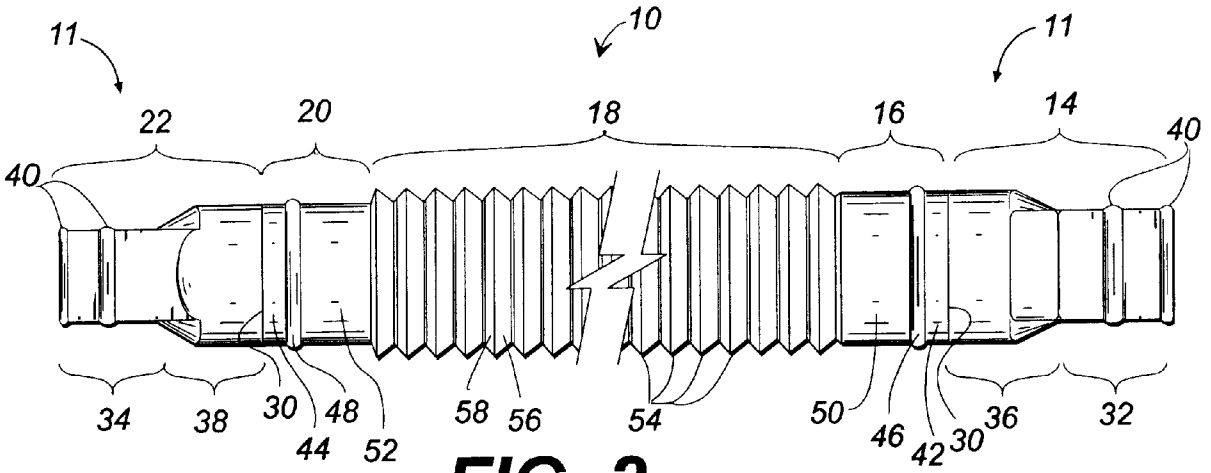
FIG. 2 is a side view of the FIG. 1 embodiment of the downspout extension connector.

Referring now to FIG. 2, a downspout extension connector 10 includes a generally elongate body 18 with obround cross section. The elongate body 18 includes a cuff 11 comprising a first selectively removable adapter portion 14 and a first interlockable end connector portion 16 located axially interior to the first selectively removable adapter portion 14. The body portion 18 is located axially interior to the first interlockable end connector portion 16. At the end of the body portion 18 opposite to the first interlockable end connector portion 16 is a second interlockable end connector portion 20. Axially adjacent to the second interlockable end connector portion 20 is a second selectively removable adapter portion 22. Cutlines 30 separate the first selectively removable adapter portion 14 from the first interlockable end connector portion 16 and the second selectively removable adapter portion 22 from the second interlockable end connector portion 20.

The selectively removable adapter portions 14 and 22 of the cuffs 11 can be removed to facilitate the connection of two or more downspout extension connectors to form a downspout extension assembly 12 such as shown in FIG. 1. A description of forming a downspout extension assembly will be given in reference to FIG. 10.

Although the connectors 10*a*, 10*b* are shown to include removable adapter portions 14, 22, it will be understood that the removable adapter portions are not required for the present invention. The main features of the present invention include the obround cross-sectional shape of the body portion, where the body portion defines corrugations that are flexible, extend, contract, and lock into position, so that the connector may be configured into any angular position and hold its position as described below. While alternative methods for coupling multiple connectors together will be described in connection with FIGS. 11 and 12, it is emphasized that the present invention is not limited to a unitary structure having adapter portions.

Referring back to FIG. 2, each selectively removable adapter portion 14 and 22 comprises a rectangular gutter adapter portions 32, 34 and transition regions 36, 38. The rectangular gutter adapter portions 32, 34 are used to connect the downspout extension connector 10 to a downspout. Each of the rectangular gutter adapter portions 32, 34 is generally rectangular in cross-section. The cross-sectional area of first rectangular gutter adapter portion 32 is larger than the cross-sectional area of second rectangular gutter adapter portion 34. The rectangular gutter adapter portions 32, 34 are of different sizes so that the downspout extension connector 10 can fit standard downspouts of two different sizes. In the preferred embodiment, first rectangular gutter adapter portion 32 has a height of three inches and a width of four inches; and rectangular gutter adapter portion 34 has a height of two inches and a width of three inches. Connecting one of the rectangular gutter adapter portions 32, 34 to a downspout will be described in the following paragraph.

Still referring to FIG. 2, a griphold 40 is located at the end of each rectangular gutter adapter portion 32, 34 and axially interior to the end of each rectangular gutter adapter portion. The gripholds 40 are raised protuberances that extend circumferentially around the gutter adapter portions 32, 34. The gripholds 40 reinforce the gutter adapter portions 32, 34 and prevent collapse of the gutter adapter portions 32, 34 during the manufacturing thereof. The gripholds 40 also provide a convenient surface to grasp when connecting or disconnecting the rectangular gutter adapter portions 32, 34 to and from a downspout. By grasping the downspout extension connector 10 around the gripholds 40, the user can slide one of the rectangular gutter adapter portions 32 or 34 around the end of a downspout to attach the downspout extension connector to a downspout. Depending on the size of the downspout, either first rectangular gutter adapter portion 32 or second rectangular gutter adapter portion 34 is connected to the downspout.

Preferably, the downspout extension connector 10 also includes mounting holes (not shown) on the sides of the rectangular gutter adapter portions 32, 34 so that the downspout extension connector 10 can be fixably mounted to a downspout with suitable mounting means, such as screws, bolts or the like.

Figures 5, 5A:
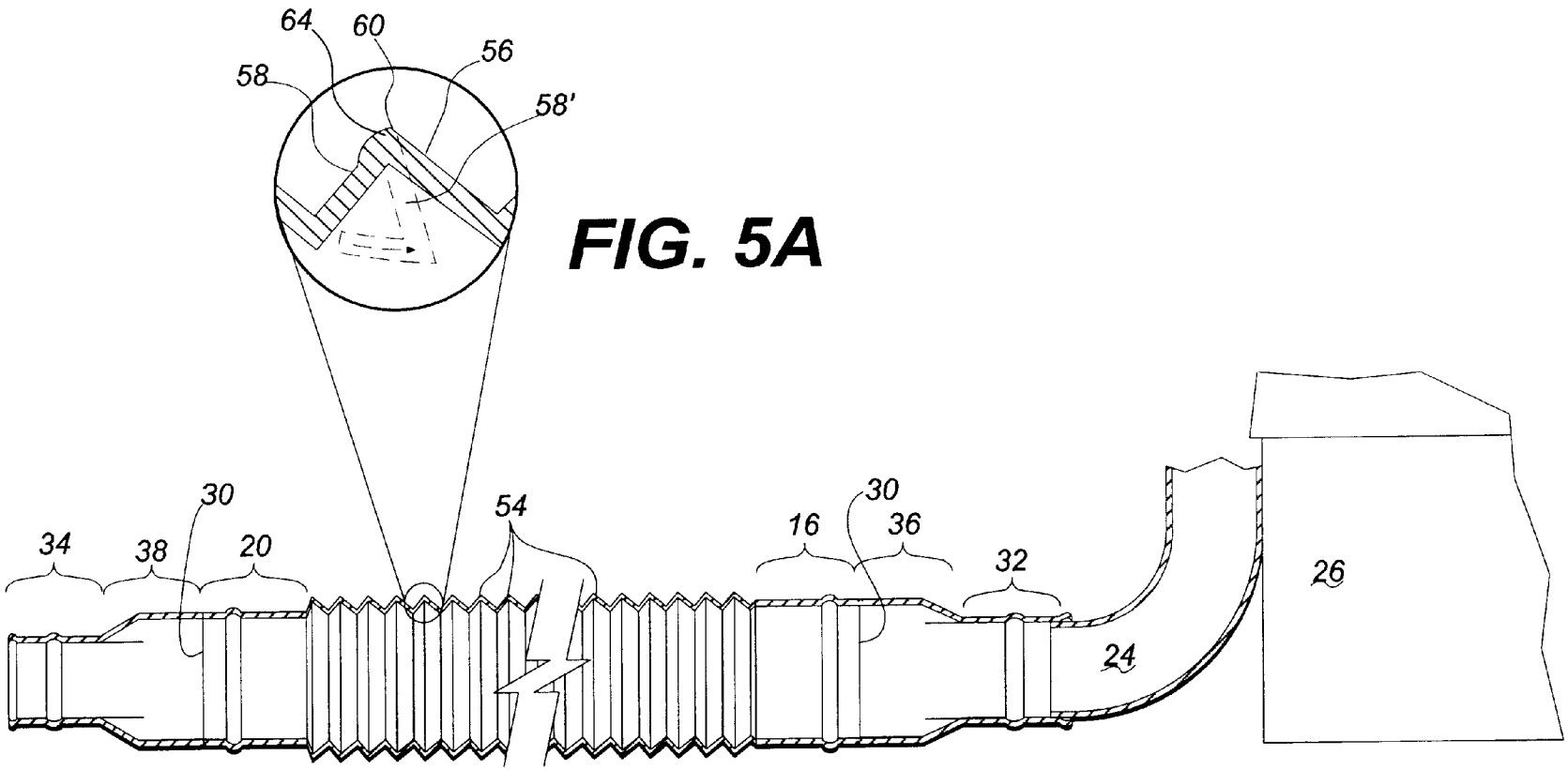
FIG. 5 is a side cross-sectional view of the FIG. 1 embodiment of the downspout extension connector attached to a downspout of a building, with an enlarged view of a collapsible corrugation.

Referring to FIG. 5, a side cross-sectional view of a downspout extension connector 10 attached to the downspout 24 of a building 26 is shown. As shown in FIG. 5, the first rectangular gutter adapter portion 32 is connected to downspout 24 demonstrating how the rectangular gutter adapter portions 32, 34 are slid around downspouts.

Referring back to FIG. 2, each selectively removable adapter portion 14, 22 also includes a transition region 36, 38. First transition region 36 is axially interior to first rectangular gutter adapter portion 32. Second transition region 38 is axially interior to second rectangular gutter adapter portion 34. Each transition region 36, 38 is a body that extends from the rectangular gutter adapter portion 32, 34 axially inward to the cutlines 30. Each transition region 36, 38 has an obround cross-section adjacent to the cutlines 30 and a generally rectangular cross-section adjacent to the rectangular gutter adapter portions 32, 34. In between the cutlines 30 and the rectangular gutter adapter portions 32, 34, the cross-sections of the transition regions 36, 38 gradually change from obround to generally rectangular.

Figure 3:
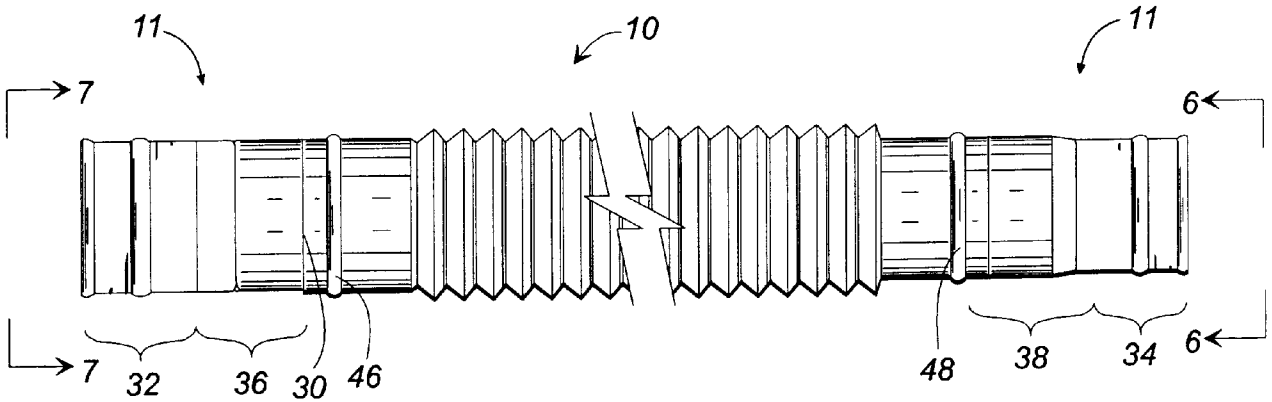
FIG. 3 is a top view of the FIG. 1 embodiment of the downspout extension connector.

Referring now to FIG. 3, a top view of the selectively removable adapter portions 14, 22 and the interlockable end connector portions 16, 20, at each end of the downspout extension connector 10 can be seen. The transition regions 36, 38 are shaded in FIG. 3 to more clearly show the transition from an obround cross-section adjacent the cutlines 30 to a generally rectangular cross-section adjacent the rectangular gutter adapter portions 32, 34.

Referring back to FIG. 2, cutlines 30 separate the first selectively removable adapter portion 14 from the first interlockable end connector portion 16 and the second selectively removable adapter portion 22 from the second interlockable end connector portion 20. Each cutline 30 is an indentation that extends around the circumference of the downspout extension connector 10. The cutlines 30 have a cross-sectional thickness that is less than the cross-sectional thickness of the selectively removable adapter portions 14, 22 and the interlockable end connector portions 16, 20 that are on either side of the cutlines. The thin cross-sectional thickness of the cutlines 30 facilitate the removal of the selectively removable adapter portions 14, 22, as will be more fully described with reference to FIG. 10.

Still referring to FIG. 2 and turning now to the interlockable end connector portions 16, 20, it will be seen that the interlockable end connector portions are axially interior to the selectively removable adapter portions 14, 22. The interlockable end connector portions 16, 20 are obround and each end connector portion extends axially inward to the adjustable portion 18. Each interlockable end connector portion 16, 20 includes an outer collar, 42, 44, a locking rib 46, 48, and an inner collar 50, 52. Each outer collar 42, 44 is positioned adjacent to and axially interior to the selectively removable adapter portions 14, 22. Each locking rib 46, 48 is adjacent to and axially interior to the outer collar 42, 44. Each inner collar 50, 52 is adjacent to and axially interior to the locking ribs 46, 48.

The outer collars 42, 44 and inner collars 50, 52 are generally cylindrical in shape with an obround cross-section. Each locking rib 46, 48 is a curved protuberance that extends circumferentially around the interlockable end connector portions 16, 20. Each locking rib 46, 48 has a cross-section that is larger than the cross-section of the outer collars 42, 44 and the inner collars 50, 52. Locking rib 46 is called a female locking rib and locking rib 48 is called a male locking rib.

Referring still to FIG. 2, the first interlockable end connector portion 16 has a slightly larger cross-section than the cross-section of the second interlockable end connector portion 20. That is, the cross-sections of outer collar 42 and inner collar 30 are larger than the cross-sections of outer collar 44 and inner collar 52. In addition, female locking rib 46 has a larger cross-section than male locking rib 48. The different-sized interlockable end connector portions 16, 20 allow two downspout extensions to be coupled and held together to form a downspout extension assembly 12 such as is shown in FIG. 1. This extension assembly capability will be more fully described below in reference to FIG. 10.

In FIG. 2, it will be seen that the body portion 18 is between the interlockable end connector portions 16 and 20. The body portion 18 comprises a plurality of collapsible corrugations 54. The accordion-like collapsible corrugations 54 allow the downspout extension connector 10 to be extended or compressed to different lengths and allow the connector 10 to be bent and held in different positions. Thus, the downspout extension connector 10 of the present invention can be compressed and bent out of the way when necessary and can be bent to avoid certain objects. For example, referring back to FIG. 1, the downspout extension connector 10*a* is bent around bush 28. In addition, the downspout extension connector 10 shown in FIG. 4 is bent to show its flexibility and locking ability.

Each collapsible corrugation 54 of the downspout extension connector 10 comprises a static side 56 and a movable side 58. The static side 56 and the movable side 58 each have a generally frusto-conical shape. As shown in FIG. 2, the movable side 58 of each collapsible corrugation 54 is as far apart from the static side 56 as possible. When the movable side 58 of a collapsible corrugation 54 is as far apart from the static side 56 as possible, the collapsible corrugation is in an extended state.

Figure 4:
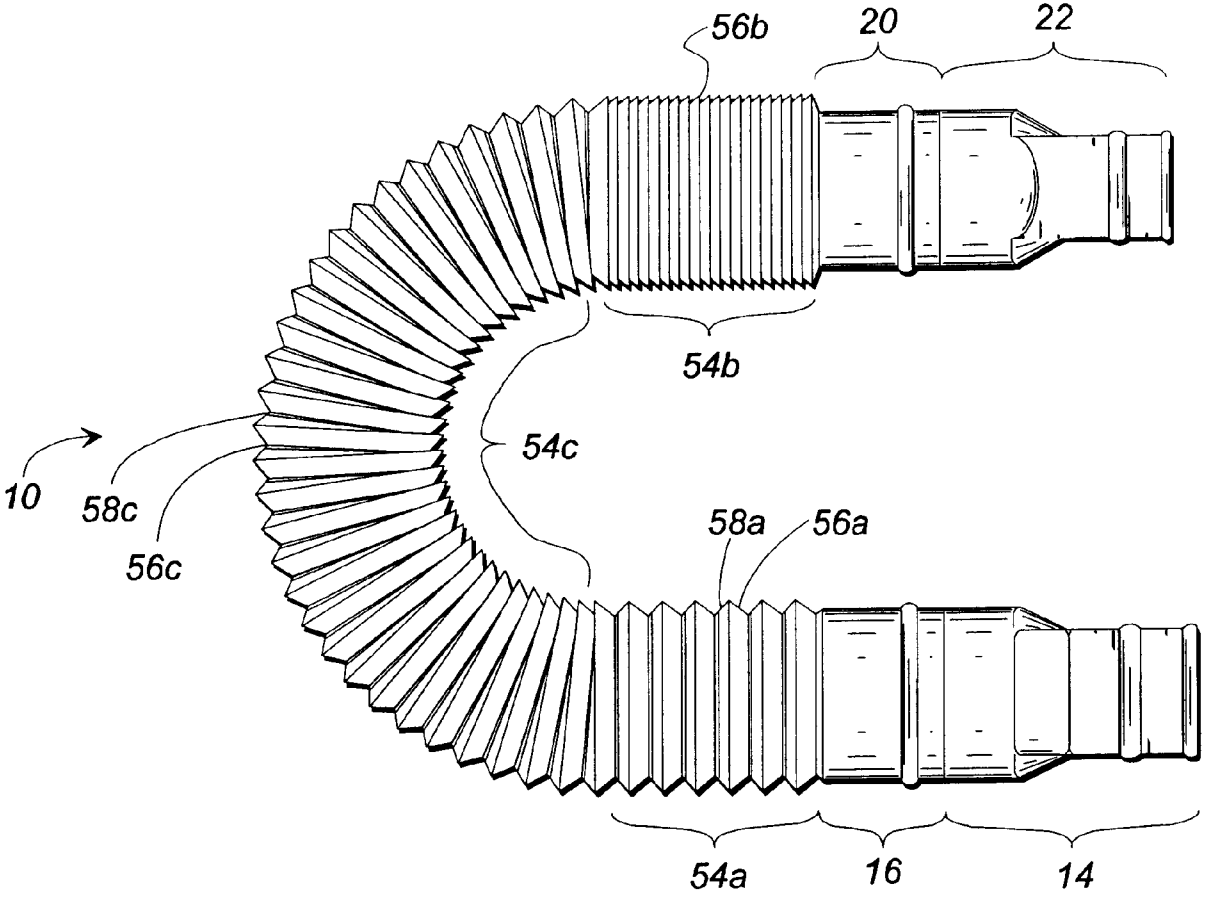
FIG. 4 is a side view of the FIG. 1 embodiment of the downspout extension connector, bent to demonstrate its flexibility.

Referring now to FIG. 4, it will be seen that the collapsible corrugations 54 can be in an extended state, a compressed state, or a halfway state. The collapsible corrugations 54*a* in FIG. 4 are in an extended state because the movable sides 58*a* are as far apart from the static sides 56*a* as possible. The collapsible corrugations 54*b* are in a compressed state because the movable sides 58*b* are as close to the static sides 56*b* as possible. The movable sides 58*b* of collapsible corrugations 54*b* are not visible in FIG. 4 because the collapsible corrugations 54*b* are in a compressed state. The collapsible corrugations 54*c* are in a halfway state, that is, part of each of the movable sides 58*c* is as close to the static sides 56*c* as possible and part of each of the movable sides is as far apart from the static side as possible.

FIG. 5 shows an enlarged view of a collapsible corrugation 54. The static side 56 and movable side 58 meet at an apex 60, with a reinforcing bead 64 protruding outwardly on the movable side 58 and extending circumferentially around the corrugation at the apex. The movable side 58 pivots about this apex 60 to either an extended state or compressed state. The movable side 58 is shown in an extended state in FIG. 5; the dashed line shows the movable side 58' in a compressed state. The reinforcing bead 64 provides circumferential rigidity to the corrugations and permits the movable side 58 to move while resisting movement of the static side 56. Furthermore, it will be appreciated that the length of the movable side 58 is shorter than the length of the static side 56, which further facilitates movement of the movable side 58.

Figure 6:
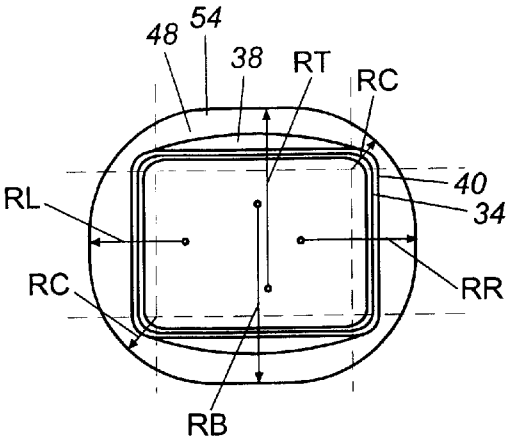
FIG. 6 is an end view of the FIG. 1 embodiment of the downspout extension connector looking along line 6—6 of FIG. 3.

Refer now to FIG. 6 for a view of downspout extension 10 taken along line 6—6 of FIG. 3. The second rectangular gutter adapter portion 34 and the gripholds 40 are almost rectangular in the end view of FIG. 6. The second transition region 38, the male locking rib 48, and the collapsible corrugation 54 are also shown.

FIG. 6 also shows various radii of curvature of the obround body portion. It is believed that the radii of curvature of the obround body have importance in forming flexible corrugations that extend, collapse, and are lockable. It is known, for example from the parent U.S. Pat. No. 5,813,701, that a downspout extension having a circular tubular body with corrugations that are circular in cross section can be made to extend, contract, and lock into position. However, the inventor is not aware of any collapsible lockable corrugations that have a more rectangular outer configuration to be more compatible with known gutter downspouts. As discussed above, it is an object of this invention to make a rainwater connector that has an outer configuration more rectangular in appearance, to be more aesthetically pleasing and compatible with the rectangular 3×4 and 2×3 inch gutter downspouts commonly found in the United States. The inventor has discovered that an obround configuration allows a more generally rectangular tubular body, with flexible corrugations that extend, collapse, and lock into position.

In this regard, FIG. 6 shows the various cross sectional curvatures as are found in preferred embodiments of the present invention. The obround body that forms apex 60 in this figure, which is considered generally rectangular, has eight (8) curved or arcuate segments, each with its own radius of curvature. The top and bottom (long) segments or sides have radii of curvature RT and RB, respectively; the left and right (short) sides or segments have radii of curvature RL and RR, respectively, and the corner segments have radii of curvature RC.

In obround configurations that are generally rectangular, the top and bottom radii RT and RB will be the same, and the left and right radii RL and RR will be the same, and the top and bottom radii RT and RB will be greater than the left and right radii RL and RR. The comer radii RC will typically be less than the top, bottom, left, and right radii RT, RB, RL, and RR for obround bodies that are generally rectangular.

Figure 28:
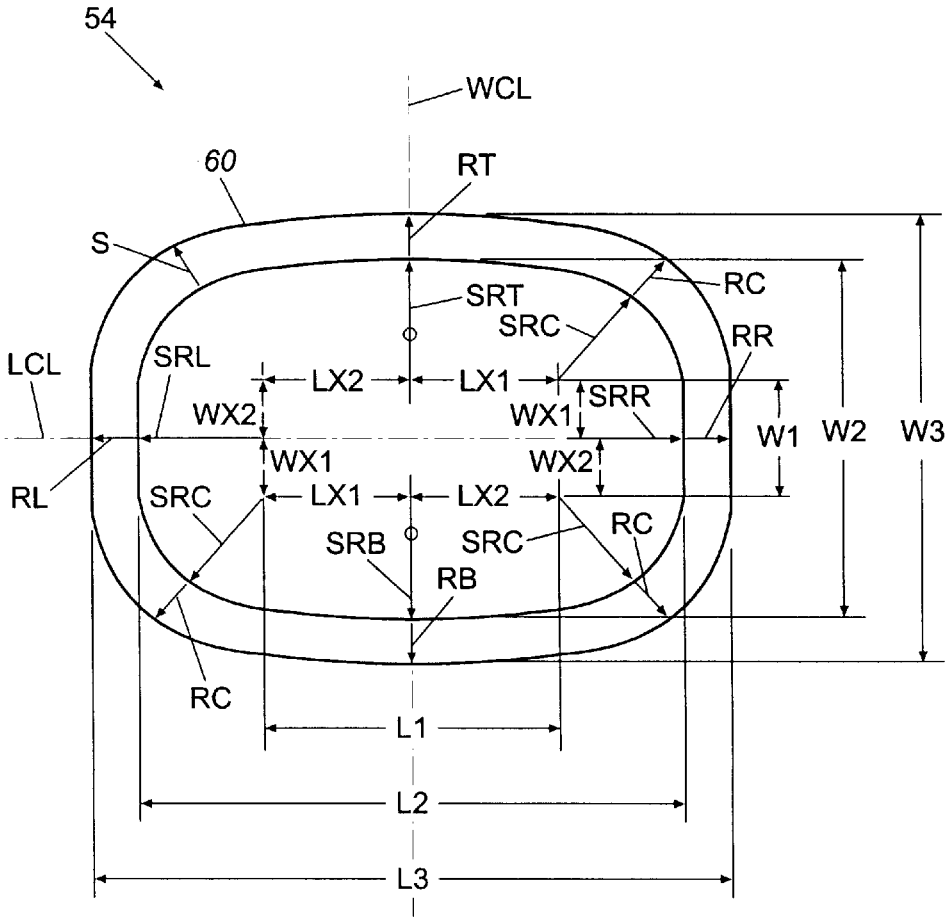
FIG. 28 illustrates the inner and outer obround cross sections of the corrugation of an obround body.

In a preferred embodiment, each corrugation 54 has an inner obround cross section S that is typically smaller than the outer obround cross section that forms apex 60 as illustrated in FIG. 28. Each inner obround section S has dimensions corresponding to the dimensions of the outer cross section forming apex 60. The radii of curvature dimensions left, right, top, bottom, and corner) SLR, SRR, SRT, SRB, and SRC of the inner obround cross section correspond to the left, right, top, bottom, and corner LR, RR, RT, RB, and RC dimensions of the outer obround cross section forming apex 60.

Still referring to FIG. 6, The centers for the top, bottom, left, and right radii RT, SRT, RB, SRB, RL, SRL, RR, and SRR dimensions are typically calculated after the centers for the corner curvature radii RC, SRC are determined. These centers for the top, bottom, left, and right radii RT, SRT, RB, SRB, RL, SRL, RR, and SRR dimensions are calculated by using at least two reference markers: The first reference marker is either the longitudinal center line LCL or width center line WCL. The second reference marker is a point where a continuous side can be made from a respective comer radius of curvature RC, SRC. For example, the center for the top radius of curvature RT is determined by taking a ray line RT having the predetermined length or radius RT and placing the center of this ray line RT along the width center line WCL. While the end or origin of the ray line remains on the width center line WCL, the arrow at the end of the ray line RT is placed on the last point of a comer radius of curvature RC. In this position, the origin of the ray line RT denotes the center of the radius of curvature RT. The ray line RT is rotated about its center and forms a side of the obround body having a radius of curvature RT.

L1 and W1 denote the distance between respective centers for comer curvature radii RC and SRC in length and width directions of the cross sections. LX1 and LX2 denote the distance between centers of curvature radii RC and SRC and a width center line WCL. Perpendicular to LX1 and LX2, WX1 and WX2 denote the distance between centers of curvature radii RC and SRC and a longitudinal center line LCL. L2 denotes the length dimension of the inner obround cross section S while L3 denotes the length dimension of the outer cross section forming apex 60. Opposite to L2 and L3, W2 and W3 denote the width dimensions of the inner obround cross section S and outer cross section forming apex 60, respectively.

The left and right curvature radii RL and RR of the outer obround cross section forming apex 60 fall within a preferred range of 4.200–5.300 inches while the left and right curvature radii SRL and SRR of the inner obround cross section S fall within a preferred range of 3.900–5.000 inches. The top and bottom curvature radii RT and RB of the outer obround cross section forming apex 60 fall within a preferred range of 8.600–9.700 inches while the top and bottom curvature radii SRT and SRB of the inner obround cross section S fall within a preferred range of 8.300–9.400 inches. The comer curvature radii RC the outer obround cross section forming apex 60 fall within a preferred range of 0.500–1.600 inches while the comer curvature radii SRC of the inner obround cross section S fall within a preferred range of 0.250–1.300 inches.

The preferred dimensions of two exemplary embodiments of molds forming the inner and outer obround cross sections of corrugations 54 are listed in Table 1 below. The actual dimensions of the obround cross sections for the corrugations 54 of the obround product are slightly less or substantially equal to the dimensions of the molds.

TABLE 1

(Mold Dimensions of Annular Members for two Exemplary Embodiments)
(in Inches)

| Dimensions | Example #1 | Example #2 |
|---|---|---|
| RL, RR | 4.780 | 4.780 |
| SRL, SRR | 4.482 | 4.482 |
| RT, RB | 9.159 | 9.192 |
| SRT, SRB | 8.861 | 8.893 |
| RC | 1.048 | 1.081 |
| SRC | 0.750 | 0.782 |
| LX1 | 0.863 | 0.863 |
| LX2 | 0.892 | 0.892 |
| L1 | 1.755 | 1.755 |
| L2 | 3.323 | 3.366 |
| L3 | 3.919 | 3.985 |
| W1 | 0.788 | 0.788 |
| W2 | 2.358 | 2.421 |
| W3 | 2.954 | 3.020 |
| WX1 | 0.408 | 0.408 |
| WX2 | 0.380 | 0.380 |

While preferred dimensions of the molds for the obround corrugations 54 are provided above, the present invention is not limited to these dimensions and includes multiples of the dimensions disclosed. For example, the dimensions of the present invention can be scaled up or down as long as each obround body is both extendable and lockable.

Figure 27:
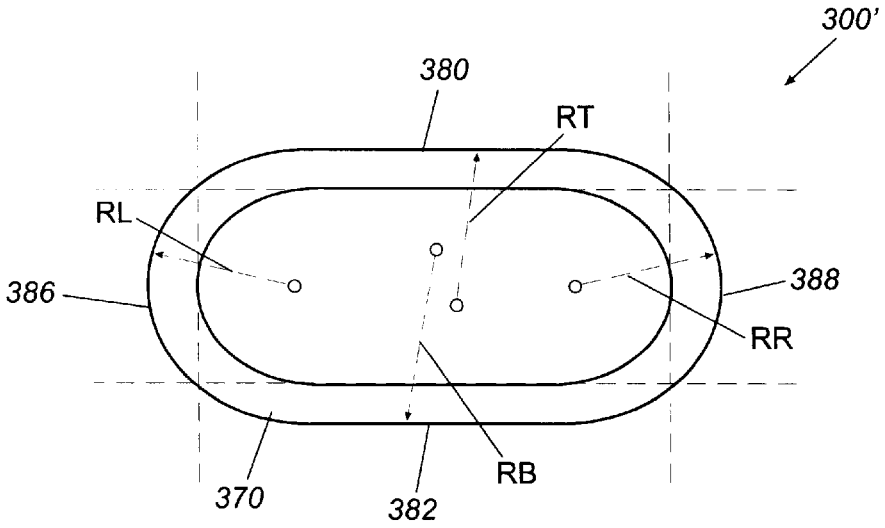
FIG. 27 is a cross-section taken along the line 26—26 of the generally elliptical body portion of the FIG. 26 elbow connector.

For obround bodies that are closer to elliptical, for example as shown in FIG. 27, there may be no separate comer radii of curvature. In this case, the radii of curvature (RL, RR) for the left and right sides will be less than the radii of curvature (RT, RB) for the top and bottom sides. In spite of not having a clearly defmed corner radius in a generally elliptical configuration, the junctions between the shorter segments (RL, RR) and the longer segments (RT, RB) will effectively have a radius of curvature like that of a comer segment RC because of the transition between the different radii (RL, RR<RT, RB). This effective comer radius of curvature should not be less than a predetermined minimum value in order to provide satisfactory locking but extendible corrugations.

It is believed that the comer radius RC (actual or effective) must have a predetermined minimum value greater than approximately ⅜ inch in order to have corrugations that satisfactorily extend, contract, and lock into position. It is also believed that there is a required proportion or relationship between the comer radii RT/RB, RL/RR, and RC, in order to provide satisfactory corrugation operation. Those skilled in the art will understand that the exact proportions and dimensions of these radii of curvature must be determined on a case by case basis for the particular application. Further, those skilled in the art will appreciate that the dimensions of the obround body of the present invention can be scaled up or down, depending on the intended application of the obround body forming the corrugations 54. Dimensions of the obround bodies that form corrugations 54 and make the device lockable and extendable can be determined by empirical testing. Such dimensions found by empirical testing to facilitate the locking and extending functions of the obround bodies are not beyond the scope of the present invention.

Figure 29:
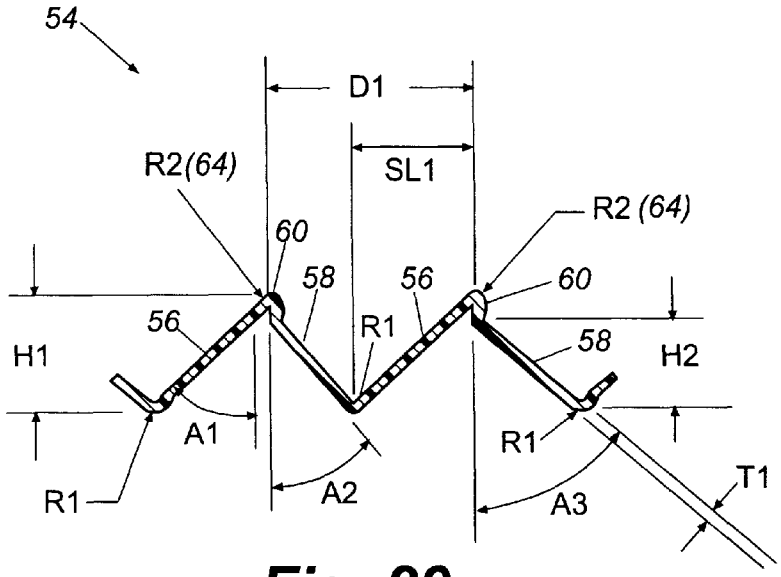
FIG. 29 illustrates a side-cross sectional view of the corrugation of an obround body.

Referring to FIG. 29, a partial side cross sectional view of corrugation 54 in an extended position. Corrugation 54 has a static side 56 and a moveable side 58 that intersect to form apex 60. Apex 60 further includes a reinforcing bead 64 that has a radius of curvature R2. Between neighboring apexes 60, there are valleys that have a radius of curvature R1. The distance between apexes 60 is denoted by D1 while the distance between an apex 60 and a valley is denoted by SL1. Similar to apexes 60, each valley with curvature radius R1 is an intersection of the static side 56 and moveable side 58. Each static side 56 has a predefined height H1 and a predefined angle A1 with respect to a vertical line while each moveable side 58 has a predefined height H2 and a predefined angle A2 or A3 with respect to a vertical line.

Preferred dimensional ranges for the mold forming the side cross section of corrugation 54 illustrated in FIG. 29 include the following: Each corrugation has a wall thickness T1 that falls within the preferred range of 0.007–0.050 inches. More specifically, the wall thickness T1 falls within the more preferred range of 0.012–0.015 inches. Each angle A1, A2, A3 falls within the preferred range of 20 degrees to 60 degrees. The separation distance D1 between respective apexes 60 preferably falls within the preferred range of 0.100–1.200 inches. The distance SL1 between valleys and apexes 60 falls within the preferred range of 0.100–0.500 inches.

Those skilled in the art will appreciate that the dimensions of the obround body of the present invention can be scaled up or down, depending on the intended application of the obround body forming the corrugations 54. The dimensions of the obround bodies that form corrugations 54 must have magnitudes such that the device is both lockable and extendable. Therefore, any dimensions found by empirical testing to facilitate the locking and extending functions of the obround bodies are not beyond the scope of the present invention.

The preferred dimensions of one exemplary embodiment of a mold forming the side cross sectional view of corrugations 54 is listed in Table 2 below. The actual dimensions of the side cross sectional view for the corrugations 54 of the obround product are slightly less or substantially equal to the dimension of the mold.

TABLE 2

(Mold Dimensions for Side Cross Section of One Exemplary Embodiment)
(in Inches/Degrees)

| Dimension | Value |
|---|---|
| A1 | 50.0 Degrees |
| A2 | 43.9 Degrees |
| A3 | 52.1 Degrees |
| R1 | 0.007 |
| R2 | 0.044 |
| H1 | 0.298 |
| H2 | 0.233 |
| D1 | 0.667 |
| SL1 | 0.374 |
| T1 | 0.015 |

While preferred dimensions of side cross section of the obround corrugations 54 are provided above, the present invention is not limited to these dimensions and includes multiples of the dimensions disclosed. For example, the dimensions of the present invention can be scaled up or down as long as each obround body is both extendable and lockable.

Figure 30:
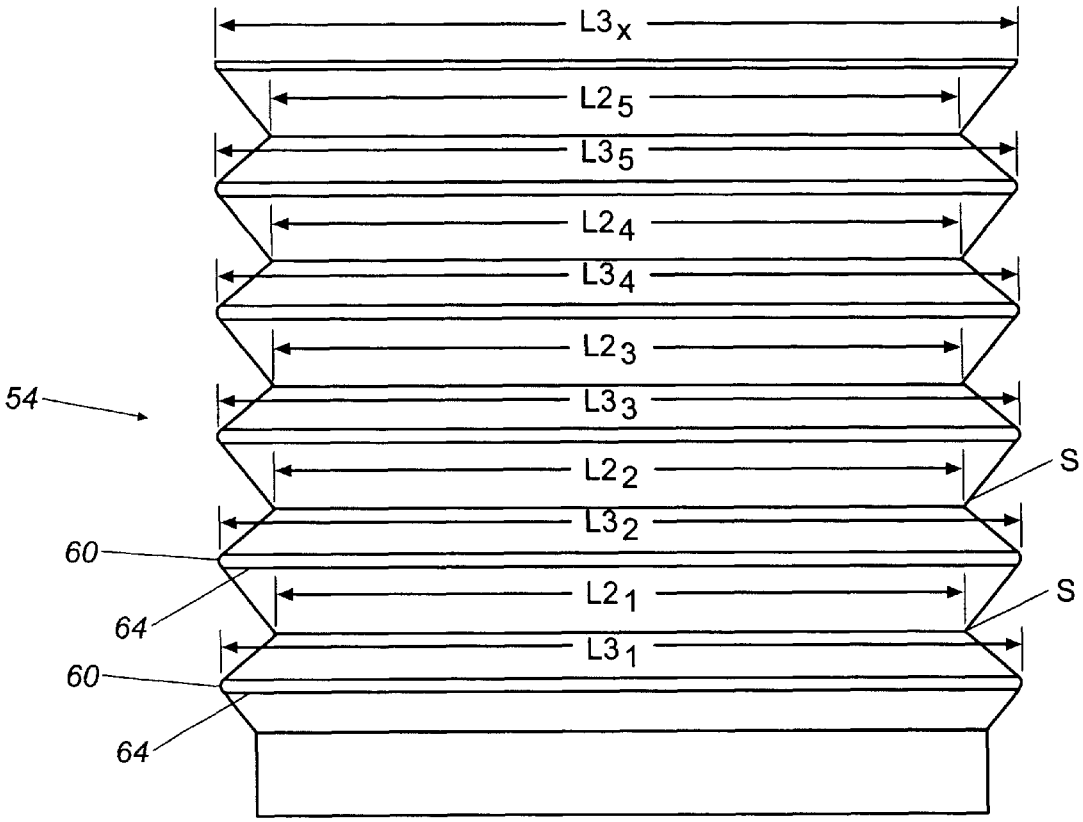
FIG. 30 illustrates the relative lengths between respective pairs of obround cross sections of the corrugation of an obround body.

While the dimensions of the inner and outer obround cross sections as well as the dimensions of the side cross section of the corrugations 54 facilitate collapsing thereof, sizing respective pairs of inner and outer obround cross sections relative to each other also enhances the collapsing of the structure as illustrated in FIG. 30. In FIG. 30, respective pairs of inner and outer obround cross sections have obround cross sectional lengths $L2_x$, $L3_x$ that decrease or increase from one end to another end of the corrugations 54. For example, in FIG. 30 the pair of obround cross sections having lengths $L2_1$, $L3_1$ are substantially greater in magnitude relative to the pair of obround cross sections having lengths $L2_2$, $L3_2$ in order to permit the collapsing of obround cross sections having lengths $L2_2$, $L3_2$ into the pair of obround cross sections having lengths $L2_1$, $L3_1$.

Figure 7:
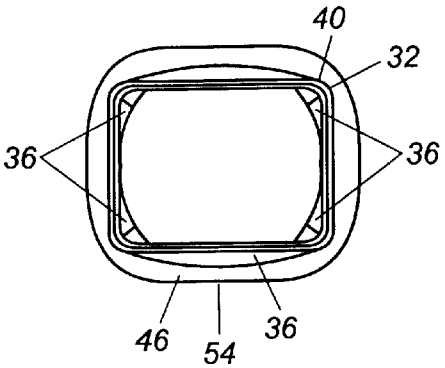
FIG. 7 is an end view of the FIG. 1 embodiment of the downspout extension connector looking along line 7—7 of FIG. 3.

Referring now to FIG. 7, a view of downspout extension connector 10 taken along line 7—7 of FIG. 3 is shown. The first rectangular gutter adapter portion 32 and gripholds 40 are shown in FIG. 7. The female locking rib 46 and a collapsible corrugation 54 can also be seen.

Figure 8:
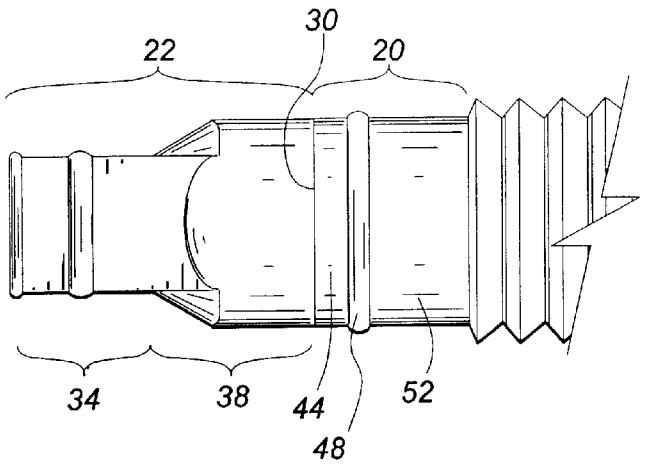
FIG. 8 is a side view of a selectively removable adapter portion and second interlockable end connector portion of the FIG. 1 downspout extension connector.

Referring now to FIG. 8, a detailed side view of the second selectively removable adapter portion 22 and the second interlockable end connector portion 20 is shown.

Figure 9:
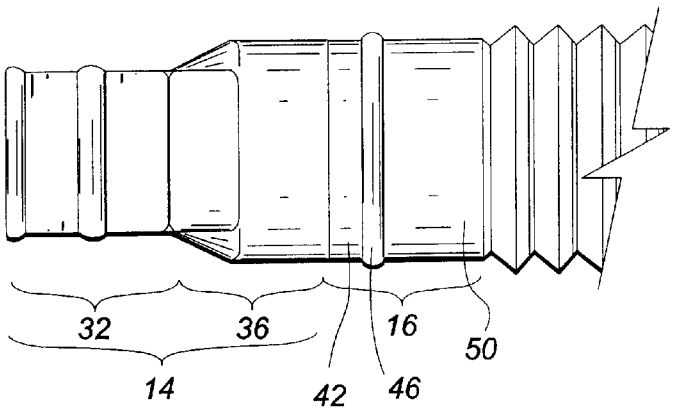
FIG. 9 is a side view of a selectively removable adapter portion and first interlockable end connector portion of the FIG. 1 embodiment of the downspout extension connector.

FIG. 9 shows a detailed side view of the first selectively removable adapter portion 14 and the first interlockable end connector portion 16. As shown in FIGS. 8 and 9, the first selectively removable adapter portion 14 is larger than the second selectively removable adapter portion 22. Also, the first interlockable end connector portion 16 has a slightly larger cross-section than the second interlockable end connector portion 20. As previously mentioned, the first selectively removable adapter portion 14 is of a different size than the second selectively removable adapter portion 22 so that first rectangular gutter adapter portion 32 will fit around a standard downspout of one size and second rectangular gutter adapter portion 34 will fit around a standard downspout of a smaller size. Another reason for the different-sized selectively removable adapter portions 14, 22 is so that the first selectively removable adapter portion 14 of a first downspout extension can be connected to the second selectively removable adapter portion 22 of a second downspout extension to form a downspout extension assembly. However, the preferred method of connecting two downspout extension connectors 10 to form a downspout extension assembly is to remove the selectively removable adapter portions 14 and 22, as will be discussed below in reference to FIG. 10.

Figure 10A:
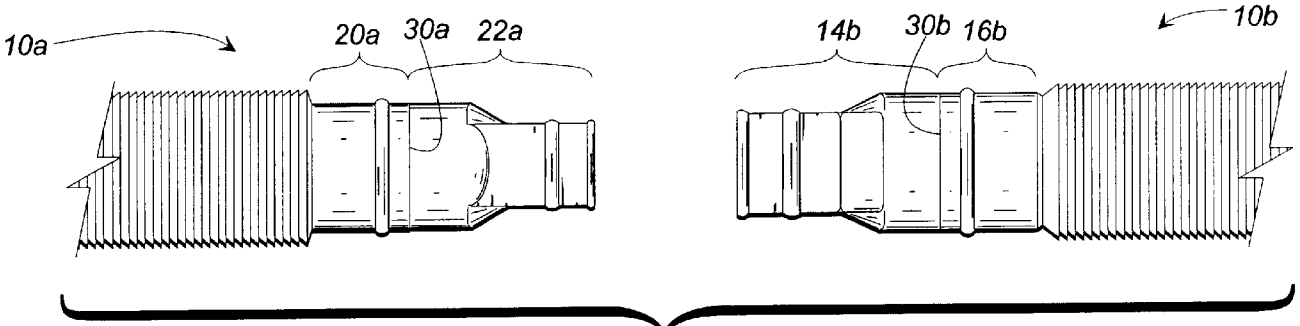
FIG. 10, consisting of FIGS. 10A–10D, are side views of a first downspout extension connector and a second downspout extension connector of the FIG. 1 embodiment prior to connection, in preparation for connection, and connection to each other.

Referring now to FIG. 10A, the second selectively removable adapter portion 22*a* and second end connector portion 20*a* of a downspout extension connector 10*a* is shown. The first selectively removable adapter portion 14*b* and first end connector portion 16*b* of downspout extension connector 10*b* is also shown in FIG. 10A.

Figure 10B:
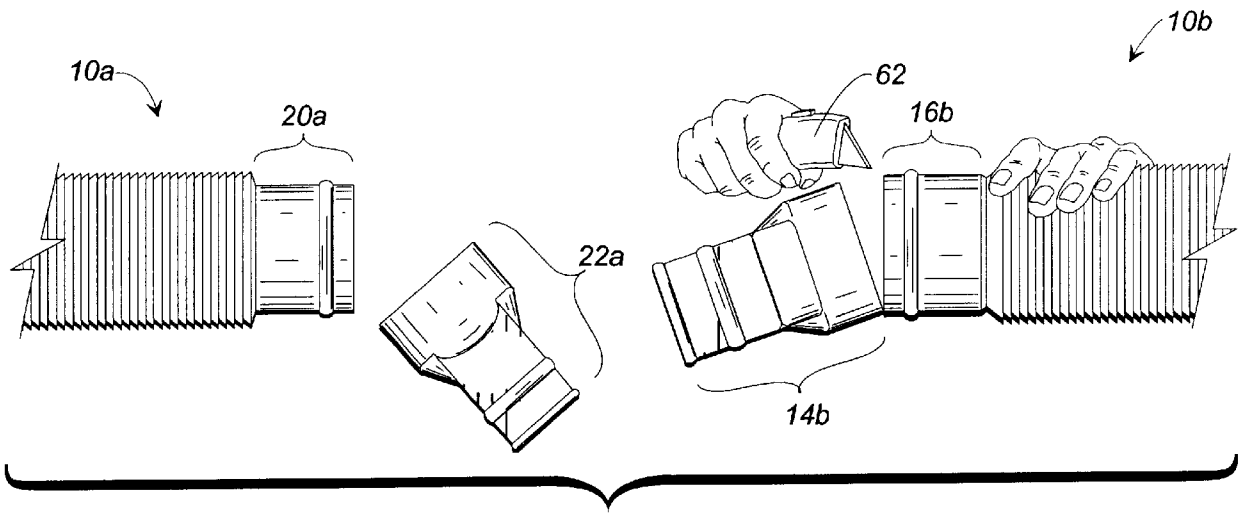

To form a downspout extension assembly, the selectively removable adapter portions 22*a* and 14*b* are removed from downspout extension connectors 10*a* and 10*b*, respectively, as shown in FIG. 10B. Preferably this is done by using an appropriate cutting tool along the cutlines 30*a* and 30*b*. The thin cross-sectional thickness of the cutlines 30*a* and 30*b* facilitates the removal of the selectively removable adapter portions 22*a* and 14*b*. As shown in FIG. 10B, a razor blade 62 can be used to remove the selectively emovable adapter portions 22*a* and 14*b*. However, other appropriate cutting tools, such as knives, saws, etc. can be used to remove the selectively removable adapter portions 22*a* and 14*b*.

Figure 10C:
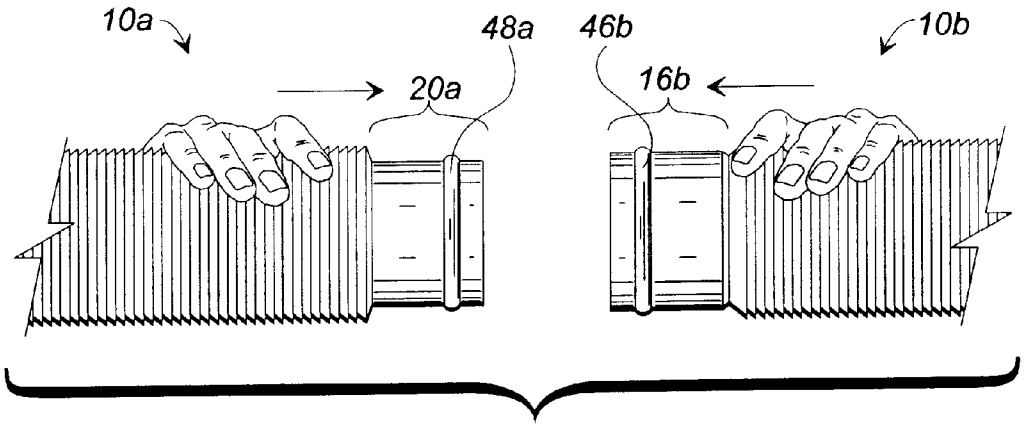

Referring now to FIG. 10C, the first end connector portion 16*b* and second end connector portion 20*a* are connected together by slipping the larger first end connector portion 16*b* around the smaller second end connector portion 20*a* until male locking rib 48*a* locks into female locking rib 46*b*. This completes the connection of downspout extension connectors 10*a* and 10*b* to form a downspout extension 12 such as is shown in side cross-sectional view in FIG. 10D.

Figure 10D:
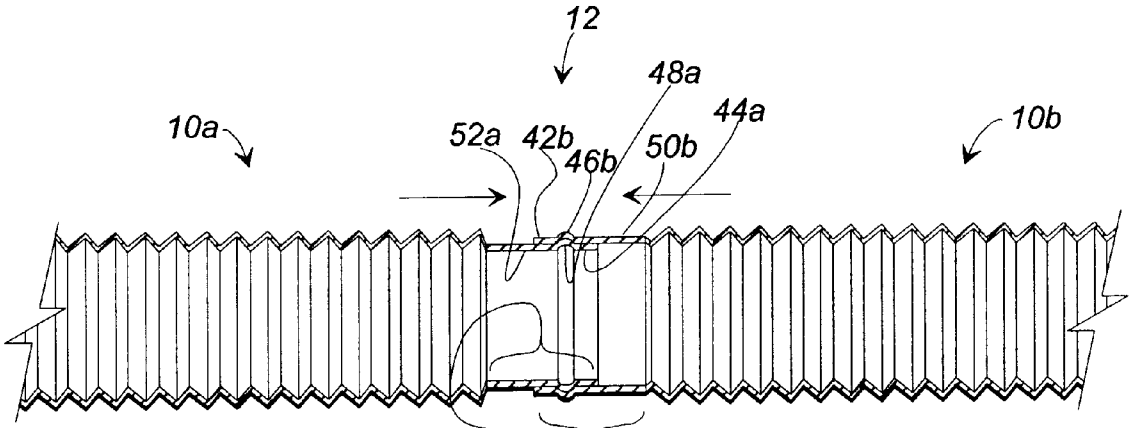

Referring to FIG. 10D, the first outer collar 42*b* surrounds the second inner collar 52*a*. The female locking rib 46*b* surrounds the male locking rib 48*a*. The first inner collar 50*b* surrounds the second outer collar 44*a*. The raised male locking rib 48*a* prevents the first outer collar 42*b* and first inner collar 50*b* from moving axially away from or towards downspout extension connector 10*a*. Thus, downspout extension connectors 10*a* and 10*b* are held together. To disconnect the downspout extension connectors 10*a* and 10*b*, the downspout extensions are pulled apart using axial force until the locking ribs 46*b* and 48*a* unlock from each other. Also, the plastic second end connector portion 20*a* can be squeezed slightly to deform the second end connector portion 20*a* and the second end connector portion 20*a* can be slid out of the first end connector portion 16*b*.

It should be noted that any number of downspout extension connectors 10 can be connected in the manner described above to form a downspout extension assembly of whatever length is required by the user.

The downspout extension connector 10 is preferably formed by the following process. A plastic liquid is extruded into a generally cylindrical die. Before the plastic sets, a mold corresponding to the shape of the downspout extension connector 10 clamps around the extruded cylindrical piece and forms or molds the downspout extension connector 10. Thus, preferably, the downspout extension connector 10 is extruded as one piece of plastic.

Figure 11A:
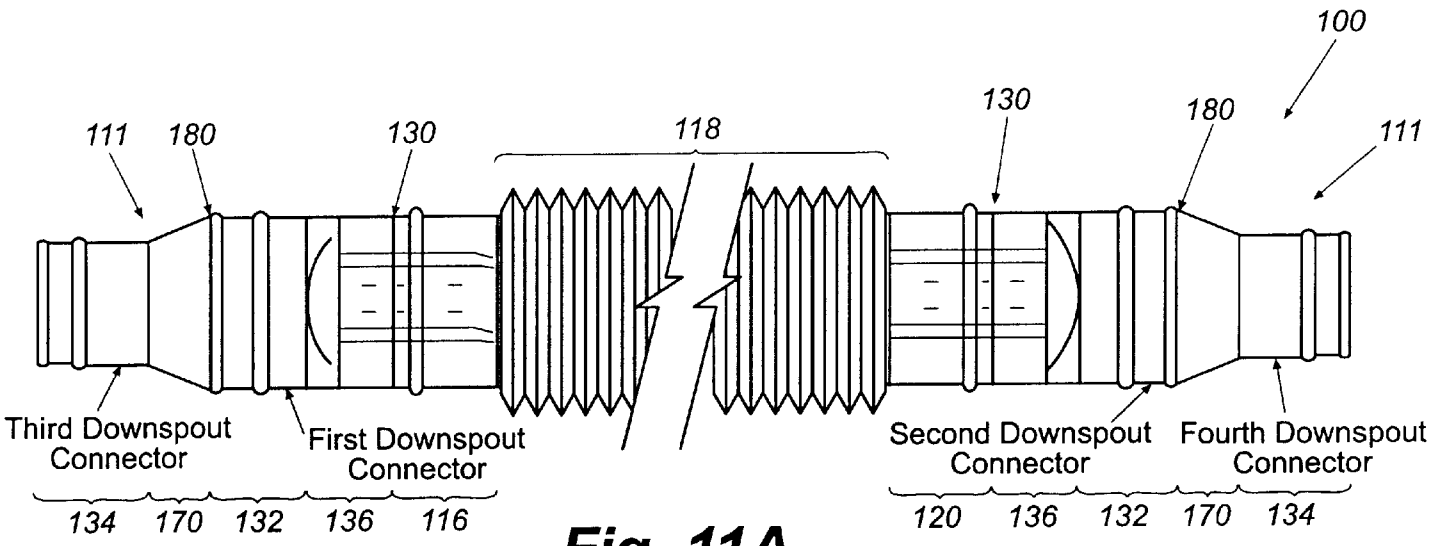
FIG. 11, consisting of FIGS. 11A and 11B, show a downspout extension connector constructed in accordance with another aspect of the present invention.
Figure 11B:
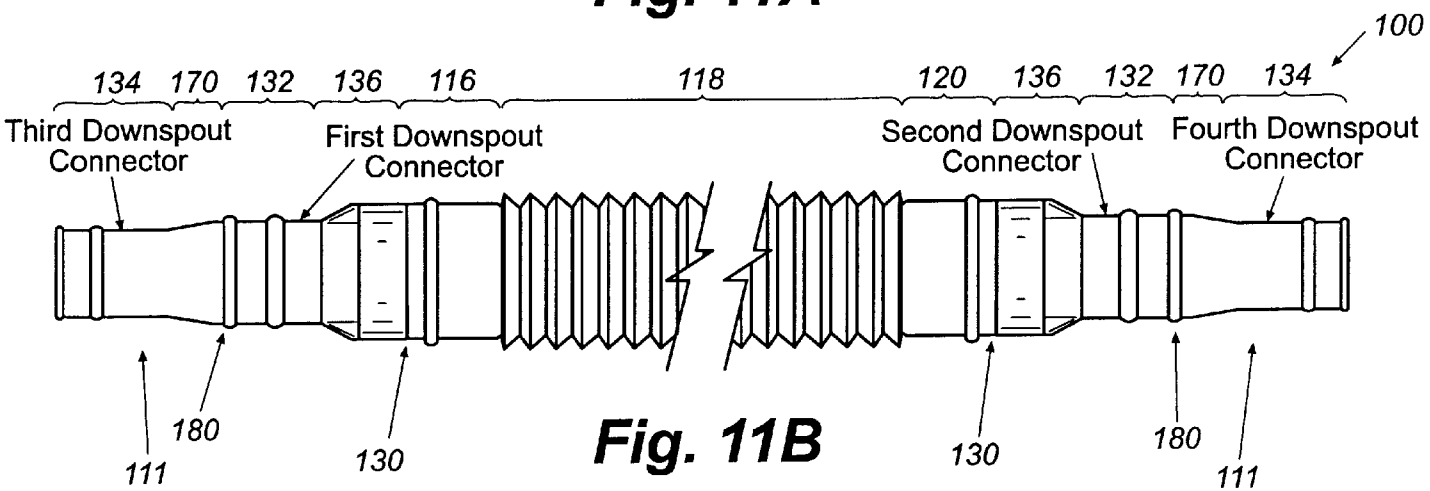

Referring now to FIG. 11, a downspout extension connector 100 constructed in accordance with an alternative embodiment of the present invention is shown. FIG. 11A is a top view of downspout extension connector 100, while FIG. 11B is a side view of the downspout extension connector. Downspout extension connector 100 includes an obround adjustable body portion 118 including collapsible corrugations, and outer cuffs 111. Body portion 118 is similar to body portion 18 described above. At one end of body portion 118 is a cuff 111 comprising an interlockable end connector portion 116. At the opposite end of adjustable portion 118 is a cuff comprising an interlockable end connector portion 120. Interlockable end connector portions 116, 120 are similar to the interlockable end connector portions 16, 20 described above.

Axially adjacent to interlockable end connector portions 116, 120 are transition regions 136. Transition regions 136 are similar to transition region 36 described above. Transition regions 136 are separated from interlockable end connector portions 116, 120 by cutlines 130. Cutlines 130 are similar to cutlines 30 described above.

Transition regions 136 gradually transition from the obround cross-section of the body 118 adjacent the interlockable end connector portions 116, 120 to a rectangular cross-section adjacent a large rectangular gutter adapter portion 132. The large rectangular gutter adapter portion 132 is axially adjacent to each of the transition regions 136. Large rectangular gutter adapter portions 132 are similar to gutter adapter portion 32 described above. Typically, each of the large rectangular gutter adapter portions has a height of three inches and a width of four inches to snugly fit around a downspout of the same or similar dimensions.

Axially adjacent to each large rectangular gutter adapter portion 132 is an adapter-to-adapter transition region 170. Each large rectangular gutter adapter portion is separated from the adapter-to-adapter transition region 170 by a cutline 180. Adapter-to-adapter transition region 170 connects the rectangular opening of large rectangular gutter adapter portion 132 to an end of a small rectangular gutter adapter portion 134. Small rectangular gutter adapter portions 134 are similar to gutter adapter portion 34 described above. Typically, each of the small rectangular gutter adapter portions has a height of two inches and a width of three inches to snugly fit around a downspout of the same or similar dimensions.

Thus, from the description given above in reference to FIGS. 11A and 11B, it should be understood that downspout extension connector 100 may be cut along cutlines 130 so that a downspout extension assembly may be formed as described above in reference to FIG. 10. It should still be further understood that downspout extension connector 100 may be cut along cutline 180 to remove the adapter-to-adapter transition region 170 and small rectangular gutter adapter portion 134. Thus, using cutlines 180, three possible states are possible for downspout extension connector 100: (1) each end of downspout extension connector 100 is a small rectangular gutter adapter portion 134 (no cutting along cutlines 180), (2) one end of downspout extension connector 100 is a small rectangular gutter adapter portion 134 and the other end is a large rectangular gutter adapter portion 132 (cutting along one of cutlines 180), and (3) each end of downspout extension connector 100 is a large rectangular gutter adapter portion 132 (cutting along both cutlines 180).

Figure 12A:
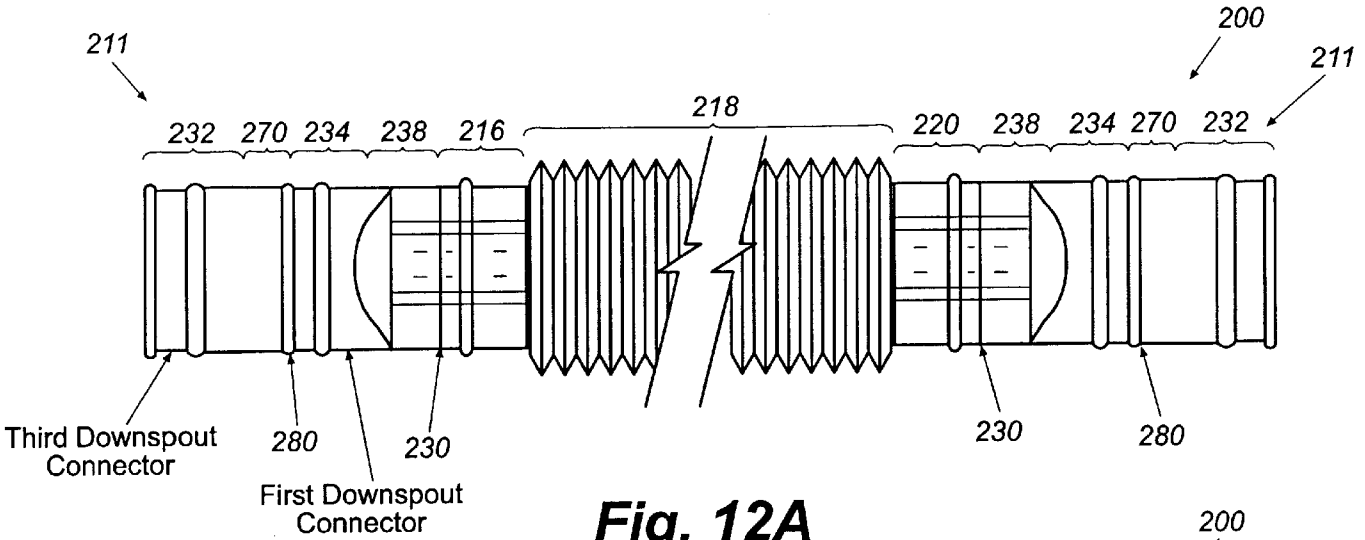
FIG. 12, consisting of FIGS. 12A and 12B, show a downspout extension connector constructed in accordance with yet another aspect of the present invention.
Figure 12B:
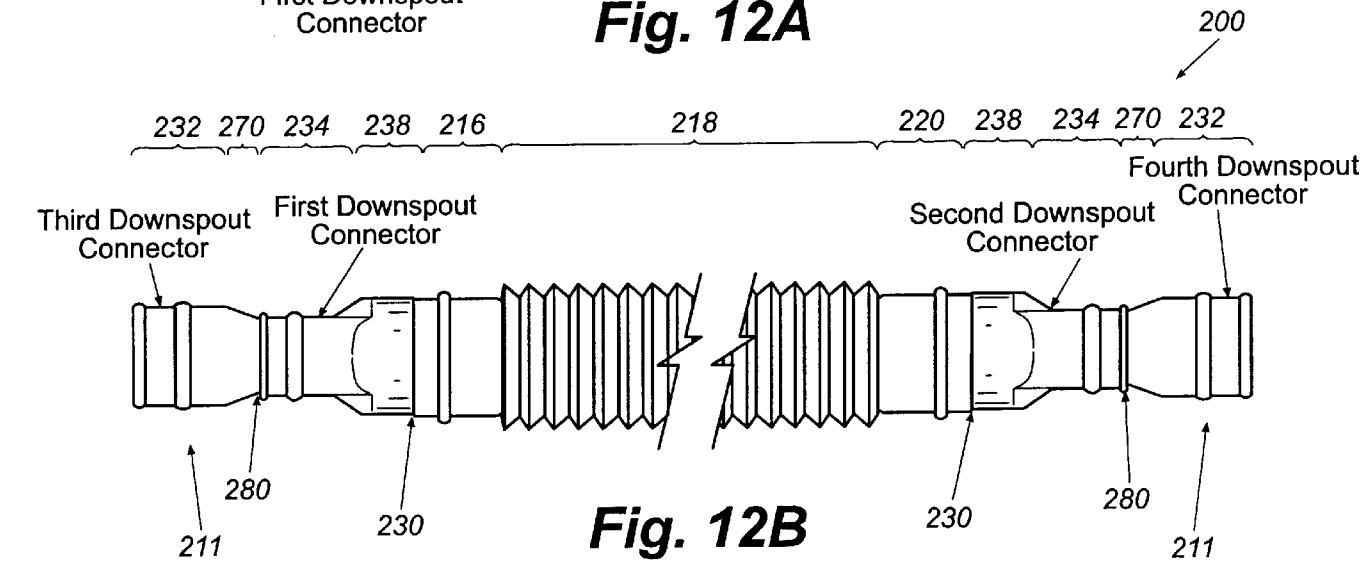

Referring now to FIG. 12, a downspout extension connector 200 in accordance with yet another alternative embodiment of the present invention is shown. FIG. 12A is a top view of downspout extension connector 200, while FIG. 12B is a side view of the downspout extension connector. Downspout extension connector 200 includes adjustable portion 218 including collapsible corrugation. Adjustable portion 218 is similar to adjustable portion 18 described above. At one end of adjustable portion 218 is a cuff 211 comprising an interlockable end connector portion 216. At the opposite end of adjustable portion 218 is a cuff 211 comprising an interlockable end connector portion 220. Interlockable end connector portions 216, 220 are similar to the interlockable end connector portions 16, 20 described above.

Axially adjacent to interlockable end connector portions 216, 220 is a transition region 238. Transition region 238 is similar to transition region 38 described above. The transition regions 238 are separated from interlockable end connector portions 216, 220 by cutlines 230. Cutlines 230 are similar to cutlines 30 described above.

Transition regions 238 gradually transition from an obround cross-section adjacent the interlockable end connector portions 216, 220 to a rectangular cross-section adjacent a small rectangular gutter adapter portion 234. The small rectangular gutter adapter portion 234 is axially adjacent to each of the transition regions 238. Small rectangular gutter adapter portions 234 are similar to gutter adapter portion 34 described above. Typically, each of the small rectangular gutter adapter portions has a height of two inches and a width of three inches to snugly fit around a downspout of the same or similar dimensions.

Axially adjacent to each small rectangular gutter adapter portion 234 is an adapter-to-adapter transition region 270. Each small rectangular gutter adapter portion is separated from the adapter-to-adapter transition region 270 by a cutline 280. Adapter-to-adapter transition region 270 connects the rectangular opening of small rectangular gutter adapter portion 234 to an end of a large rectangular gutter adapter portion 232. Large rectangular gutter adapter portions 232 are similar to gutter adapter portion 32 described above. Typically, each of the large rectangular gutter adapter portions has a height of three inches and a width of four inches to snugly fit around a downspout of the same or similar dimensions.

Thus, from the description given above in reference to FIGS. 12A and 12B, it should be understood that downspout extension connector 200 may be cut along cutlines 230 so that a downspout extension assembly may be formed as described above in reference to FIG. 10. It should still be further understood that downspout extension connector 200 may be cut along cutline 280 to remove the adapter-to-adapter transition region 270 and large rectangular gutter adapter portion 232. Thus, using cutlines 280, three possible states are possible for downspout extension connector 200: (1) each end of downspout extension connector 200 is a large rectangular gutter adapter portion 232 (no cutting along cutlines 280), (2) one end of downspout extension connector 200 connector is a small rectangular gutter adapter portion 234 and the other end is a large rectangular gutter adapter portion 232 (cutting along one of cutlines 280), and (3) each end of downspout extension 200 is a small rectangular gutter adapter portion 234 (cutting along both cutlines 280).

Figure 13:
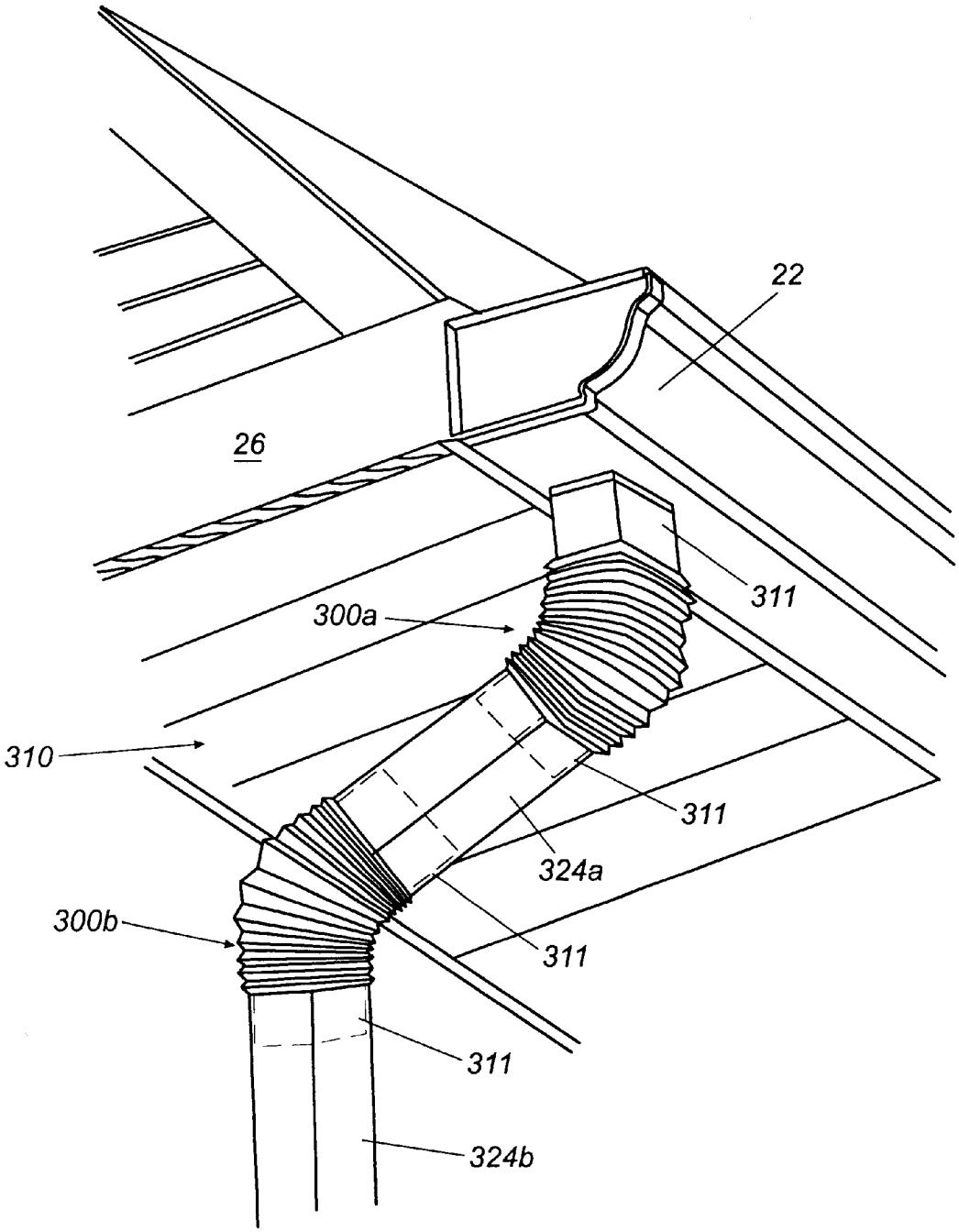
FIG. 13 is a perspective view of a pair of interlocked repositionable elbow connectors constructed in accordance with yet another aspect of the present invention, attached to a gutter and forming a downspout assembly.
Figure 14:
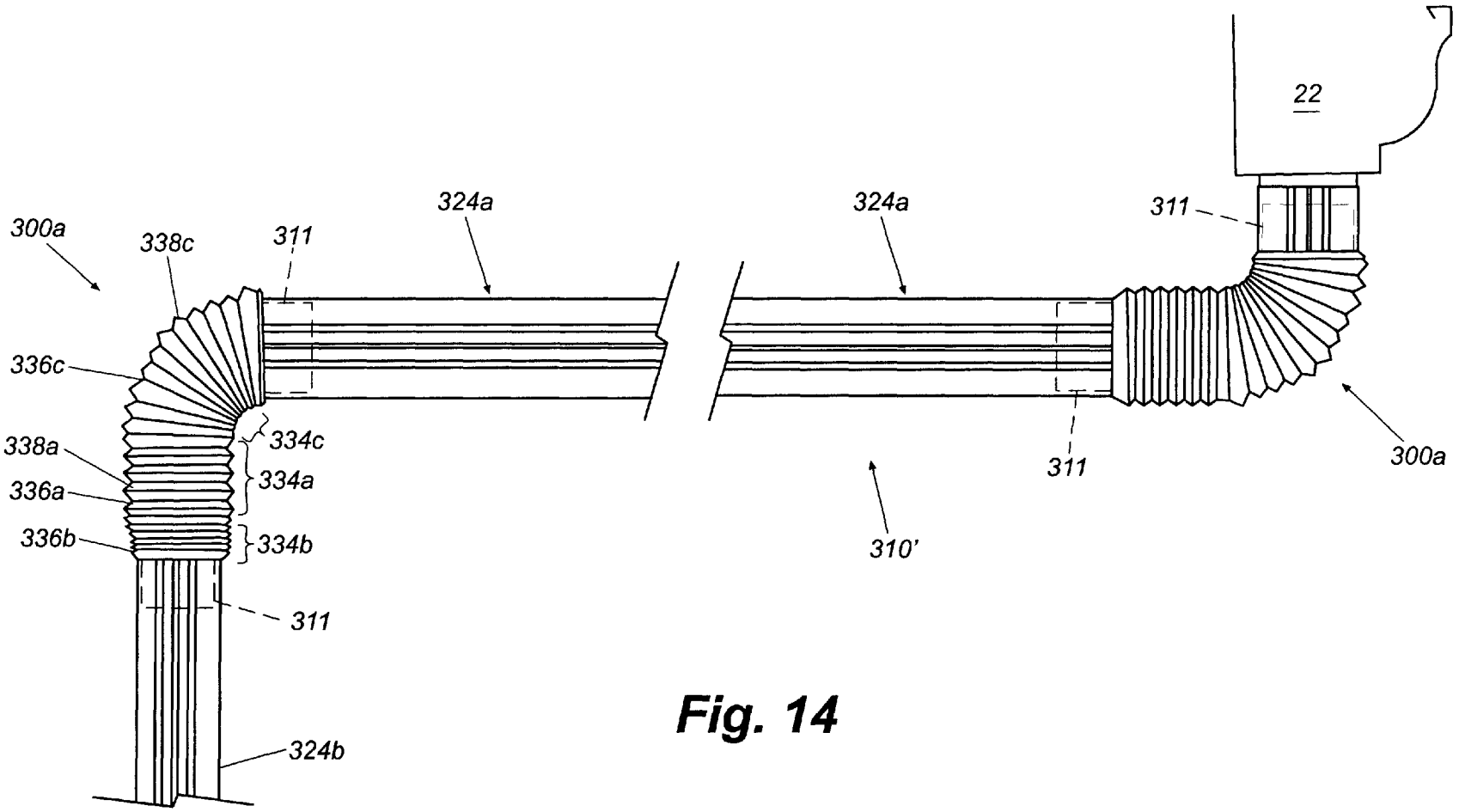
FIG. 14 is a side view of two interlocked repositionable elbow connectors of the FIG. 13 embodiment attached to a gutter and forming a downspout assembly.
Figure 15:
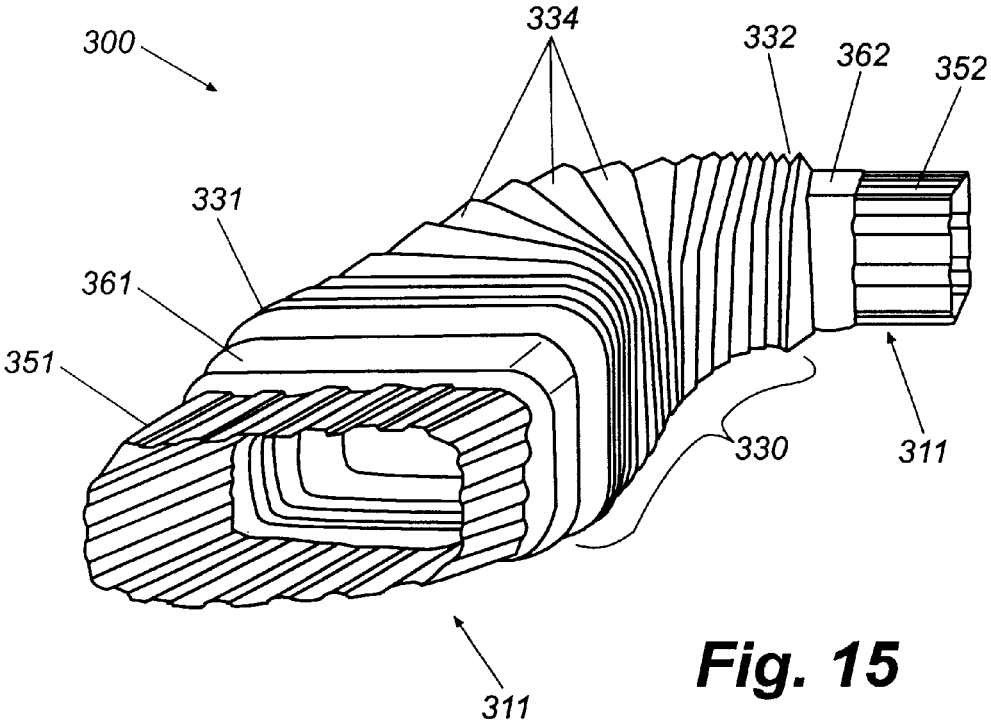
FIG. 15 is a perspective view of an elbow connector of the FIG. 13 embodiment having one of its ends angled to the right to demonstrate its flexibility.
Figure 16:
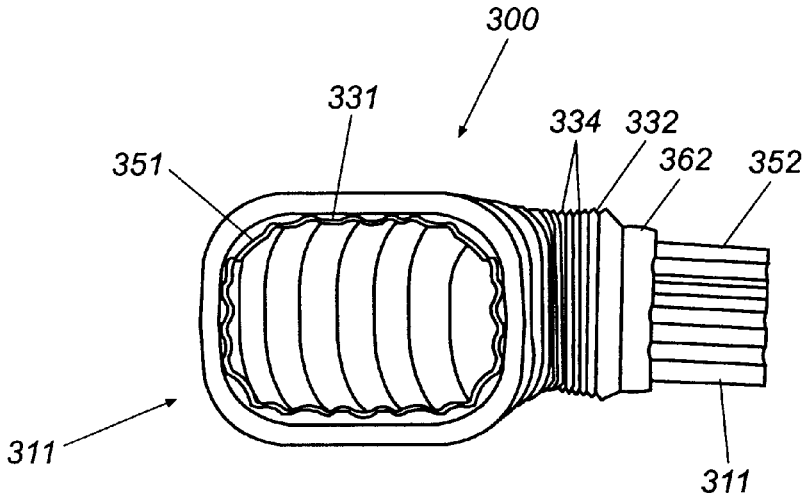
FIG. 16 is a front view of the elbow connector illustrated in FIG. 15.
Figure 17:
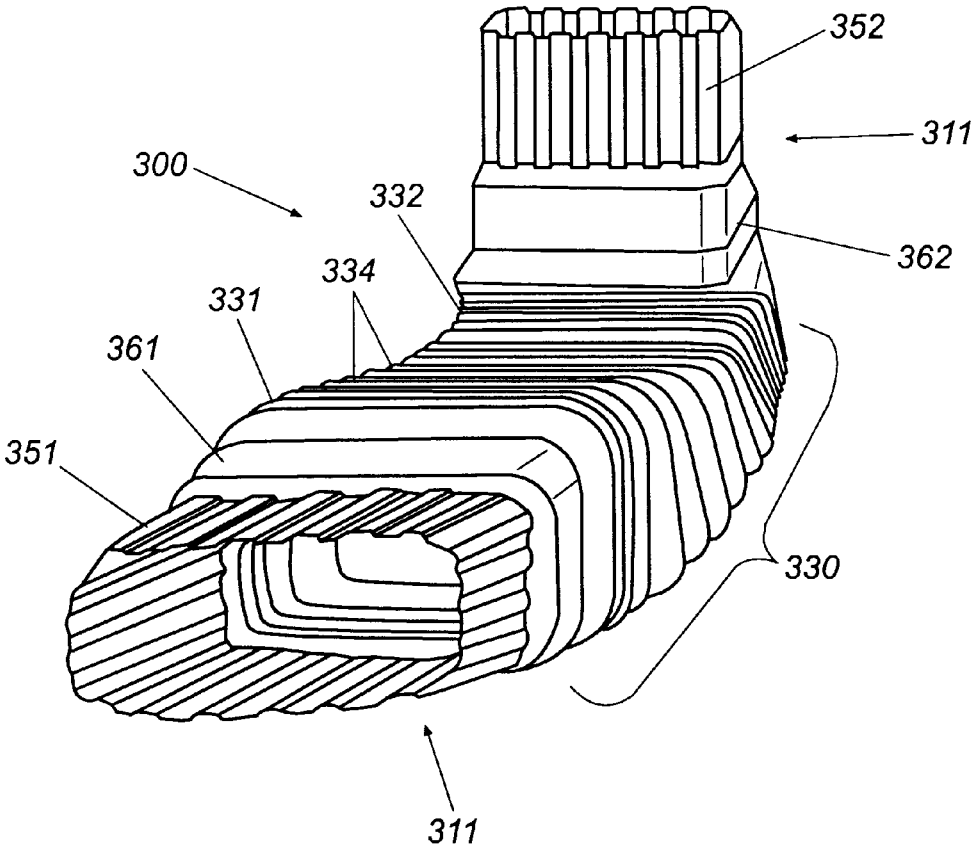
FIG. 17 is a perspective view of an elbow connector of the FIG. 13 embodiment having one of its ends angled upward to demonstrate the flexibility of the present invention.
Figure 18:
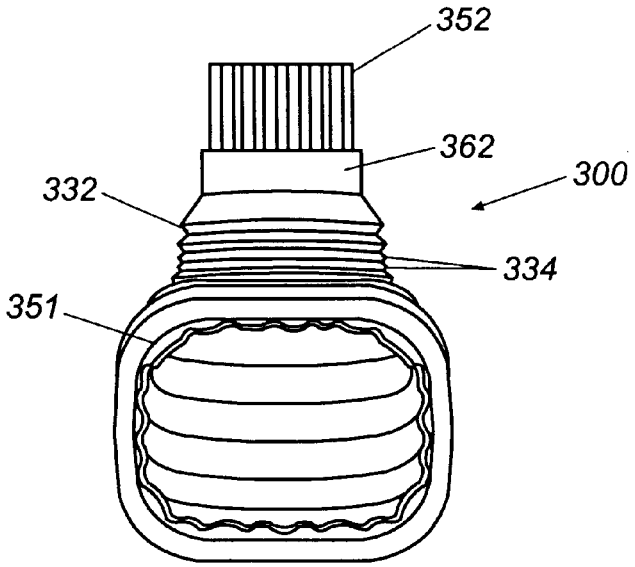
FIG. 18 is a front view of the elbow connector illustrated in FIG. 17.

FIG. 13 illustrates yet another embodiment of the present invention, a repositionable elbow connector 300. In particular, FIG. 13 illustrates two interlocked repositionable elbow connectors 300*a* and 300*b* attached to a gutter 22 and interlocking with rectangular downspout portions 324*a* and 324*b* to form a downspout assembly 310 associated with the building 26. Although the downspout assembly 310 is shown in FIG. 13 as made up of two downspout portions 324, with portion 324*a* being relatively short, a downspout assembly may be made up of any number of downspout portions, and of different lengths. For example, FIG. 14 shows an alternative downspout assembly 310' illustrating a side view of the two interlocked repositionable elbow connectors 300*a* and 300*b* attached to the gutter 22 and forming the downspout assembly 310' of the building 26, where the downspout portion 324*a* is of much greater length than as shown in FIG. 13.

The elbow connector 300*a* is connected to the gutter 22 running along the length of the overhang portion of the roof of building 26. Rainwater from the roof of building 26 flows from the roof into gutter 22. Because of a slight decline in the direction of the downspout assembly 310, the force of gravity will cause the rainwater to travel down the decline, through the elbow connector 300*a*, the downspout portion 324*a*, the elbow connector 300*b*, and the downspout portion 324*b*, and then exit from the opening of the downspout adjacent the ground.

Figure 23:
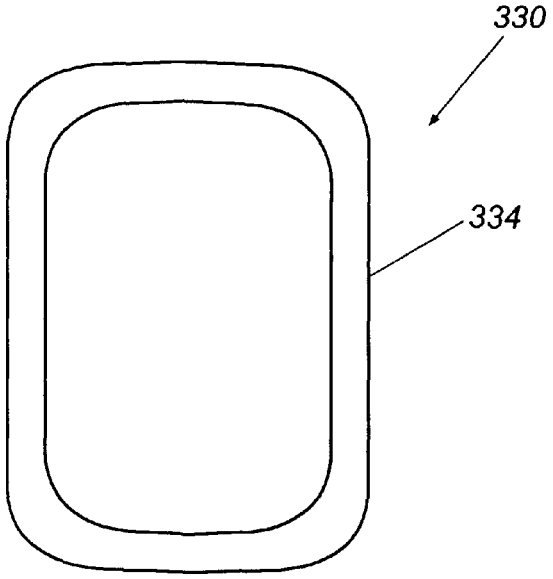
FIG. 23 illustrates a cross-sectional view taken along line 23—23 of FIG. 21.

Each elbow connector 300*a* and 300*b* has an elongate, generally obround body portion 330 and outer cuffs 311 comprising first and second ends 331 and 332, respectively. A cross-sectional view of the body portion 330 is shown in FIG. 23. The body portion 330 also comprises a plurality of collapsible corrugations 334 which are similar to the collapsible corrugations 54 described above. The accordion-like collapsible corrugations 334 allow the elbow connectors, 300*a* and 300*b*, to be extended or compressed into different selectable lengths and to be bent and locked in different angular positions. Thus, the elbow connectors 300*a*, 300*b* of the present invention can be extended, compressed, and bent as necessary to align the downspout assembly against the building 26.

The elbow connector 300 is preferably formed by the following process. A plastic liquid is extruded into a generally cylindrical die. Before the plastic sets, a mold corresponding to the shape of the elbow connector clamps around the extruded obround body portion and forms or molds the elbow connector. Thus, preferably, the elbow connector is extruded as one piece of plastic.

The elbow connector 300 shown in FIGS. 15–18 is bent to show its flexibility and locking ability. In order to have flexibility and locking ability, each collapsible corrugation 334 comprises a lockable annular member defmed by a static side 336, a movable side 338, and a reinforcing bead 364 extending circumferentially about the corrugation (see FIG. 22). The static side 336 and the movable side 338 each have a generally frusto-conical shape. The movable side 338 of each collapsible corrugation 334 is as far apart from the static side 336 as possible. When the movable side 338 of a collapsible corrugation 334 is as far apart from the static side 336 as possible, the collapsible corrugation is in an extended state.

Referring to FIG. 14, it will be seen that the collapsible corrugations 334 can be in an extended state, a compressed state, or a halfway state. The corrugations of elbow 300*b* which are in an extended state are designated with the reference numeral 334*a*, the corrugations which are in the compressed state are designated with the reference 334*b*, and the corrugations which are in the halfway state are designated with the reference numeral 334*c*.

The collapsible corrugations 334*a* in FIG. 14 are in an extended state because the movable sides 338*a* are as far apart from the static sides 336*a* as possible. The collapsible corrugations 334*b* are in a compressed state because the movable sides 338*b* are as close to the static sides 336*b* as possible. The movable sides 338*b* of collapsible corrugations 334*b* are not visible in FIG. 14 because the collapsible corrugations 334*b* are in a compressed state. The collapsible corrugations 334*c* are in a halfway state, that is, part of each of the movable sides 338*c* is as close to the static sides 336*c* as possible and part of each of the movable sides 338*c* is as far apart from the static side 336*c* as possible.

FIG. 19 illustrates a front view of a straightened elbow connector 300 in the extended state. FIG. 20 illustrates the side view of the elbow connector shown in FIG. 19. FIG. 21 illustrates the body portion 330 and its collapsible corrugations 334.

Referring now to FIG. 22, an enlarged view of a collapsible corrugation 334 is shown. The static side 336 and movable side 338 meet at an apex 350, with a reinforcing bead 364 protruding outwardly on the movable side 338. The movable side 338 pivots about this apex 350 to either an extended state or a compressed state. In FIG. 22, the movable side 338 is shown in an extended state and a dashed-line movable side 338' is shown in a compressed state. As in other embodiments the bead 364 provides circumferential rigidity for the lockable, extendible, collapsible corrugations.

Figure 24:
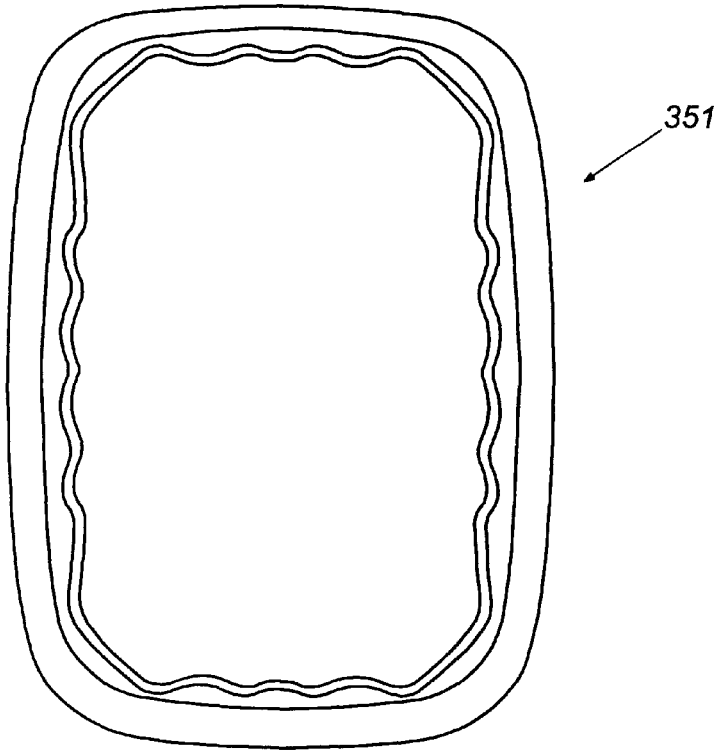
FIG. 24 illustrates an end view of the FIG. 13 elbow connector looking along line 24—24 of FIG. 19.

The cuffs 311 of the preferred elbow connector 300 include first and second end connector portions 351 and 352. The first end connector portion 351 is affixed to the first end 331 of the body portion 330 and the second end connector 352 is affixed to the second end 332 of the body portion 330. The end connector portions 351, 352 are generally rectangular in cross-section. FIG. 24 illustrates a view of end connector portion 351 taken along line 24—24 of FIG. 19.

Preferably, the first end connector portion 351 is of slightly larger rectangular dimension than the second end connector portion 352 to allow a second end connector portion 352 to be coupled to a first end connector portion by sliding insertion and engagement. Furthermore, both end connector portions 351, 352 are preferably ribbed, as best seen in FIG. 24, so as to present an appearance matching that of many commonly found gutters downspouts.

Between the first end connector portion 351 and the first end 331 of the body portion 330 is a first transition region 361 and between the second end connector portion 352 and the second end 332 of the body portion 330 is a second transition region 362. The transition regions 361, 362 have a generally rectangular cross-section adjacent the end connector portions 351, 352 and transition in cross-section to a generally obround cross-section adjacent the body portion 330. That is, the transition regions 361 and 362 change from the obround cross-section of the body portion 330 to the rectangular cross-section of the end connector portions 351 and 352.

As mentioned, the first end connector portion 351 has a slightly larger cross-section than the cross-section of the second end connector 352. However, the periphery of the end connectors 351 and 352 are otherwise identically shaped. The different-sized end connector portions allow the downspout portions 324*a* and 324*b* to be connected and held together to form a downspout assembly 310 as shown in FIGS. 13 and 14. The first end connector portion 351 is commonly referred to as female and the second end connector portion 352 is commonly referred to as male. Therefore, the end connector portion 351 is sized to fit around the exterior of an end of a standard downspout portion or gutter with the end of the downspout or gutter abutting the transition portion 362 and the end connector portion 352 is sized to fit within the interior of an end of a standard downspout portion. However, when adjoining two elbow connectors directly together, the female end connector portion 351 of one elbow connector fits over the transition portion 362 as well as the male connector portion 352 of the other elbow connector.

The elbow connector 300 also can include mounting holes (not shown) on the sides of each of the rectangular end connector portions 351 and 352 so that the elbow connector can be fixably mounted to a downspout portion and/or gutter with suitable mounting means, such as screws, bolts or the like.

Figure 25:
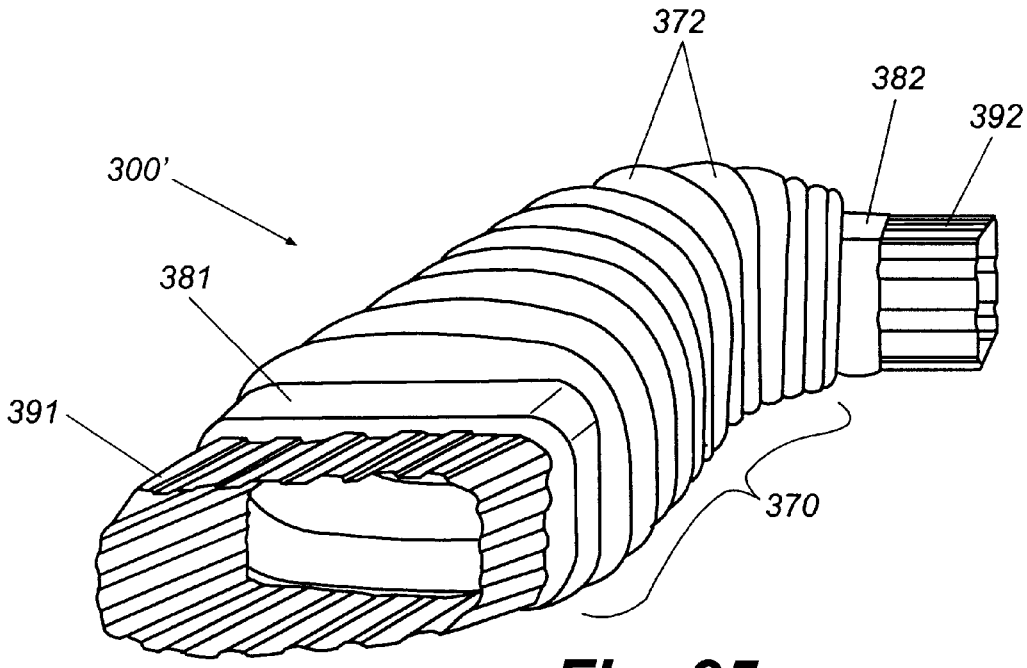
FIG. 25 illustrates yet another embodiment of an elbow connector with a generally elliptical body portion.
Figure 26:
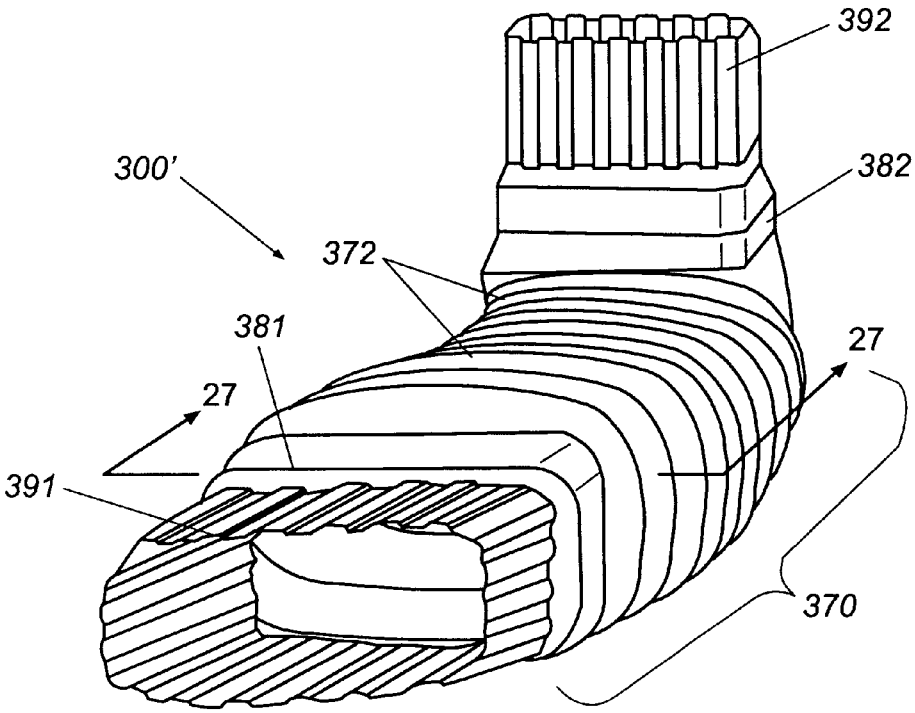
FIG. 26 illustrates another view of the FIG. 25 elbow.

FIGS. 25 and 26 illustrate an alternative elbow connector 300' having a generally elliptical body portion 370, which, as discussed above, is considered obround. The body is generally elliptical in that it has an elliptical overall appearance, but may not be a true ellipse. Rather, and as shown in FIG. 27, the body has two curved long sides 380, 382 having similar curvature, and two curved shorter sides 386, 388 having similar curvature.

As in other embodiments, the body portion 370 of the elbow connector 300' comprises a plurality of collapsible corrugations 372 which operate in a manner similar to the collapsible corrugations 54 and 334 described above. The elbow connector 321 includes transition regions 381 and 382 and end connector portions 391 and 392. Each transition region 381, 382 has an obround cross-section adjacent to the body portion 370 and a generally rectangular cross-section adjacent to the rectangular end connector portions 391 and 392.

Given the foregoing disclosure of the preferred embodiment and design parameters for the present invention, other embodiments of the present invention will suggest themselves to those skilled in the art. Therefore, the scope of the present invention is to be limited only by the claims below.

What is claimed is:

1. An integrally molded, repositionable connector in combination with a gutter or gutter downspout, the gutter or gutter downspout having a rectangular cross-sectional end, said connector for connection to the rectangular cross-sectional end of the gutter or gutter downspout, said connector comprising:

an elongate body having first and second ends and having a generally rectangular cross section defined by a first pair of arcuate segments, a second pair of arcuate segments, and a plurality of third arcuate segments, each of said arcuate segments having a radius of curvature;

said first pair of arcuate segments having a radius of curvature that is larger than the radius of curvature of said second pair of arcuate segments, thereby defining said generally rectangular cross section;

said third arcuate segments being smaller than the radii of curvature of said first pair of arcuate segments and said second pair of arcuate segments and defining rounded corners of said cross section;

said body comprising a plurality of collapsible corrugations, said collapsible corrugations comprising lockable annular members that allow said body to extend, contract, bend, and lock into selectable lengths and angular positions; and first and second end connector portions affixed at said first and second ends, respectively.

2. The connector of claim 1 wherein the connector is a downspout extension connector.

3. The connector of claim 1 wherein the connector is an elbow connector.

4. The connector of claim 1 wherein the first and second end connector portions are generally rectangular in cross-section.

5. The connector of claim 4 further comprising first and second selectively removable adapter portions affixed axially adjacent to said first and second end connector portions, respectively, said first and second selectively removable adapter portions being generally rectangular in cross-section.

6. The connector of claim 5 wherein said first selectively removable adapter portion has a larger cross-sectional area than said first end connector portion and said second selectively removable adapter portion has a larger cross-sectional area than said second end connector portion.

7. The connector of claim 5 wherein said first selectively removable adapter portion has a smaller cross-sectional area than said first end connector portion and said second selectively removable adapter portion has a smaller cross-sectional area than said second end connector portion.

8. The connector of claim 5 wherein said first selectively removable adapter portion has a smaller cross-sectional area than said first end connector portion and said second selectively removable adapter portion has a larger cross-sectional area than said second end connector portion.

9. The connector of claim 5 further comprising a first transition region between said first end connector portion and said first selectively removable adapter portion and a second transition region between said second end connector portion and said second selectively removable adapter portion.

10. The connector of claim 9 further comprising a first cutline between said first transition region and said first selectively removable adapter portion and a second cutline between said second transition region and said second selectively removable adapter portion, whereby said first selectively removable adapter portion may be removed by cutting along said first cutline and said selectively removable adapter portion may be removed by cutting along said second cutline.

11. The connector of claim 1 further comprising:

a first means associated with said first end for locking said repositionable connector to a mating locking means associated with a downspout accessory; and a second means associated with said second end for locking said repositionable connector to a mating locking means associated with a downspout accessory.

12. The repositionable connector of claim 11 wherein said first locking means comprises a male locking rib at said first end and said second locking means comprises a female locking rib at said second end, said male locking rib and female locking rib each comprising a protuberance that extends circumferentially around said end connector portions, said protuberance around said first end connector portion having a greater radial dimension than the radial dimension of said first end connector portion, and said protuberance around said second end connector portion having a greater radial dimension than the radial dimension of said second end connector portion.

13. The connector of claim 1, further comprising a selectively removable adapter portion affixed axially adjacent to one of said first and second end connector portions, said selectively removable adapter portion being generally rectangular in cross-section.

14. An integrally molded, repositionable rainwater connector in combination with a gutter or gutter downspout, the gutter or gutter downspout having a rectangular cross-sectional discharge end, the connector for connection to the rectangular cross-sectional discharge end, the connector comprising:

an elongate body having first and second ends and having a generally rectangular cross section defined by a first pair of arcuate segments, a second pair of arcuate segments, and a plurality of third arcuate segments, each of said arcuate segments having a radius of curvature;

said first pair of arcuate segments having a radius of curvature that is larger than the radius of curvature of said second pair of arcuate segments, thereby defining said generally rectangular cross section;

the radius of curvature of said third arcuate segments being smaller than the radii of curvature of said first pair of arcuate segments and said second pair of arcuate segments, thereby defining rounded corners of said cross section;

said body comprising a plurality of collapsible corrugations, said collapsible corrugations comprising lockable annular members that allow the body to extend, contract, bend, and lock into selectable lengths and angular positions; and first and second cuffs affixed at said first and second ends, respectively, said first and second downspout cuffs being generally rectangular in cross-section whereby the connector can be connected to said discharge port of said gutter or said gutter downspout.

15. The rainwater connector of claim 14, further comprising a first transition region between said first cuff and said first end and a second transition region between said second cuff and said second end, wherein said transition regions have a generally rectangular cross-section adjacent said downspout connectors and transition in cross section to an obround cross-section.

16. The rainwater connector of claim 14, wherein said first cuff has a larger cross-sectional area than the cross-sectional area of said second cuff.

17. The rainwater connector of claim 14, wherein said first cuff has a larger cross-sectional area than the cross-sectional area of said second cuff, whereby said first cuff of a first rainwater connector can be connected to a second cuff of a second rainwater connector to form an extension assembly.

18. The rainwater connector extension of claim 14, wherein said body further comprises a male locking rib at said first end and a female locking rib at said second end, said male locking rib and female locking rib each comprising a protuberance that extends circumferentially around said body, said protuberance having a radius greater than the radius of said body;

whereby the first end of a first rainwater connector can be fixably held to a second end of a second rainwater connector.

19. The rainwater connector of claim 14, wherein said first end and said second end of said body have obround cross-sections, and wherein said circular cross-section of said first end has a smaller radius than a radius of said circular cross-section at said second end, wherein said connectors at said first and second ends are removable; and whereby a portion of a first rainwater connector and a portion of a second rainwater connector can be removed, whereby the first end of the first rainwater connector can be connected to the second end of the second rainwater connector to form a downspout extension assembly.

20. An integrally molded, repositionable rainwater connector in combination with a gutter downspout, said gutter downspout having a rectangular cross-sectional end, the rainwater connector for connection to the discharge end of the rectangular cross-sectional end of the gutter downspout, the rainwater connector comprising:

an elongate body with first and second ends and having a generally rectangular cross section defined by a first pair of arcuate segments, a second pair of arcuate segments, and a plurality of third arcuate segments, each of said arcuate segments having a radius of curvature;

said first pair of arcuate segments having a radius of curvature that is larger than the radius of curvature of said second pair of arcuate segments, thereby defining said generally rectangular cross section;

the radius of curvature of said third arcuate segments being smaller than the radii of curvature of said first pair of arcuate segments and said second pair of arcuate segments, thereby defining rounded corners of said cross section;

said body including a plurality of collapsible, extendible, and lockable corrugations, and connectors of rectangular cross section affixed at said first and second ends for connection to the rectangular gutter downspout, whereby the extension may be extended, contracted, bent, and locked into selectable lengths and angular positions.

21. The rainwater connector of claim 20, further comprising transition regions at said ends of said body from said generally rectangular cross section of said body to the rectangular cross section of said connectors.

22. The rainwater connector of claim 20, wherein said collapsible corrugations comprise static sides and movable sides;

whereby the rainwater connector can be extended by manually pulling the movable sides away from the static sides until the movable sides lock into position, and whereby the rainwater connector can be compressed by pushing the movable sides towards the static sides until the movable sides lock into position.

23. The rainwater connector of claim 20, further comprising locking means comprising a female locking rib at said first end of said body and a male locking rib at said second end of said body, said female locking rib and male locking rib each comprising a curved protuberance extending circumferentially around said body, said protuberance having a radius greater than the radius of said body, said protuberance of said female locking rib having a radius greater than said protuberance of said male locking rib.

24. The rainwater connector of claim 20 wherein said cross-section of said connector at said first end is larger than said cross-section of said connector at said second end;

whereby the first end of a first rainwater connector can be connected to the second end of a second rainwater connector to form a downspout extension assembly.

25. The rainwater connector of claim 20 wherein said cross-section of said connector at said first end is larger than said cross-section of said connector at said second end; and further comprising locking means comprising a female locking rib axially interior to said first end of said body and a male locking rib axially interior to said second end of said body, said female locking rib and male locking rib each comprising a curved protuberance extending circumferentially around said body, said protuberance having a radius greater than the radius of said body, said protuberance at said female locking rib having a radius greater than said protuberance of said male locking rib;

whereby the first end of a first rainwater connector can be connected to the second end of a second rainwater connector after removal of said connectors to form a downspout extension assembly, and whereby the female locking rib of the first rainwater connector and the male locking rib of the second rainwater connector are in frictional contact with each other and prevent the first rainwater connector and second rainwater connector from moving relative to each other.

26. The rainwater connector of claim 20, wherein said first and and said second end of said body have generally rectangular cross-sections, and wherein said cross-section of said first end has smaller dimensions than the dimensions of said cross-section at said second end; and wherein said connectors at said first and second ends are removable;

whereby the connector at a first end of a first do rainwater connector and the connector at a second end of a second rainwater connector can be removed, whereby the first end of the first rainwater connector can be connected to the second end of the second rainwater connector to form a downspout extension assembly.

27. The rainwater connector of claim 20, wherein said first end and said second end of said body have generally rectangular cross-sections, and wherein said cross-section of said first end has larger dimensions than the dimensions of said cross-section at said second end;

further comprising locking means comprising a female locking rib axially interior to said first end of said body and a male locking rib axially interior to said second end of said body, said female locking rib and male locking rib each comprising a curved protuberance extending circumferentially around said body, said protuberance of said female locking rib having dimensions greater than said protuberance of said male locking rib;

wherein said connectors at said first and second ends are removable;

whereby the connector at a first end of a first rainwater connector and the connector at a second end of a second rainwater connector can be removed, whereby the first end of the first rainwater connector can be connected to the second end of a second rainwater connector to form a downspout extension assembly; and whereby the female locking rib of the first rainwater connector and the male locking rib of the second rainwater connector are in frictional contact with each other and prevent the first rainwater connector and second rainwater connector from moving relative to each other.

28. The rainwater connector of claim 20, wherein the first pair of arcuate segments comprise a pair of long segments, the second pair of arcuate segments comprise a pair of short segments, and the comer segments join the long segments to the short segments.

29. The rainwater connector of claim 28, wherein the radius of curvature of the long segments is larger than the radius of curvature of the short segments, and the radius of curvature of the corner segments is shorter than the radius of curvature of the long and short segments.

30. The rainwater connector of claim 29, wherein the radius of curvature of the comer segments is no less than about ⅜ inch.

31. An integrally molded, repositionable rainwater connector in combination with a gutter or gutter downspout, said gutter or gutter downspout having a rectangular cross-sectional end, the rainwater connector for connection to the rectangular cross-sectional end of the gutter or gutter downspout, the rainwater connector comprising:

an elongate generally tubular body having first and second ends and having a generally rectangular cross section defined by a first pair of arcuate segments, a second pair of arcuate segments, and a plurality of third arcuate segments, each of said arcuate segments having a radius of curvature;

said first pair of arcuate segments having a radius of curvature that is larger than the radius of curvature of said second pair of arcuate segments, thereby defining said generally rectangular cross section;

the radius of curvature of said third arcuate segments being smaller than the radii of curvature of said first pair of arcuate segments and said second pair of arcuate segments, thereby defining rounded corners of said cross section;

said body comprising a plurality of collapsible corrugations, said collapsible corrugations comprising lockable annular members that allow said body to extend, contract, bend, and lock into selectable lengths and angular positions;

first and second downspout connectors affixed at said first and second ends, respectively, said first and second downspout connectors being generally rectangular in cross-section; and third and fourth downspout connectors affixed axially adjacent to said first and second downspout connectors, respectively, said third and fourth downspout connectors being generally rectangular in cross-section.

32. The rainwater connector of claim 31, further comprising a first transition region between said first downspout connector and said third downspout connector and a second transition region between said second downspout connector and said fourth downspout connector.

33. The rainwater connector of claim 32, further comprising a first cutline between said first transition region and said third downspout connector and a second cutline between said second transition region and said fourth downspout connector, whereby said third downspout connector may be removed by cutting along said first cutline and said fourth downspout connector may be removed by cutting along said second cutline.

34. The rainwater connector of claim 31 wherein said third downspout connector has a larger cross-sectional area than said first downspout connector and said fourth downspout connector has a larger cross-sectional area than said second downspout connector.

35. The rainwater connector of claim 31 wherein said third downspout connector has a smaller cross-sectional area than said first downspout connector and said fourth downspout connector has a smaller cross-sectional area than said second downspout connector.

36. The rainwater connector of claim 31 wherein said third downspout connector has a smaller cross-sectional area than said first downspout connector and said fourth downspout connector has a larger cross-sectional area than said second downspout connector.

37. The rainwater connector of claim 31, further comprising:

a first means associated with said first end for locking the rainwater connector to a mating locking means associated with a downspout accessory; and a second means associated with said second end for locking the rainwater connector to a mating locking means associated with a downspout accessory.

38. The rainwater connector of claim 31, wherein said first locking means comprises a male locking rib at said first end and said second locking means comprises a female locking rib at said second end, said male locking rib and female locking rib each comprising a protuberance that extends circumferentially around said body, said protuberance having a dimension greater than the dimension of said body.

39. The rainwater connector of claim 31 wherein said third downspout connector is of a different size than said first downspout connector and said fourth downspout connector is of a different size than said second downspout connector.

40. An integrally molded, repositionable connector comprising:

an elongate body having first and second ends and having a generally rectangular cross section defined by a first pair of arcuate segments, a second pair of arcuate segments, and a plurality of third arcuate segments, each of said arcuate segments having a radius of curvature;

said first pair of arcuate segments having a radius of curvature that is larger than the radius of curvature of said second pair of arcuate segments, thereby defining said generally rectangular cross section;

the radius of curvature of said third arcuate segments being smaller than the radii of curvature of said first pair of arcuate segments and said second pair of arcuate segments, thereby defining rounded corners of said cross section;

said body comprising a plurality of collapsible corrugations, said collapsible corrugations comprising lockable annular members that allow said body to extend, contract, bend, and lock into selectable lengths and angular positions, each annular member including said arcuate segments defining said body.

41. The connector of claim 40, wherein each arcuate segment is one of a corner arcuate segment, a length side arcuate segment, and a width side arcuate segment forming an annular member of said elongate obround body.

42. The connector of claim 40, wherein each annular member has at least eight arcuate segments.

43. The connector of claim 40, wherein each annular member has at least four pairs of arcuate segments.

44. The connector of claim 40, wherein one of said plurality of arcuate segments of each annular member defines a comer arcuate segment while another of said plurality of arcuate segments defines a side arcuate segment, each side arcuate segment having a first radius of curvature and each comer arcuate segment having a second radius of curvature, said first radius of curvature being substantially greater than said second radius of curvature.

45. The connector of claim 40, wherein each annular member is one of a first group and second group of annular members, each member of said first group of annular members defining a first cross sectional area, each member of said second group of annular members defining a second cross sectional area, each second cross sectional area being substantially greater than each first cross sectional area.

46. The connector of claim 40, wherein each annular member has a predefined thickness, said predefined thickness being generally within the range of 0.007–0.050 inches.

47. The connector of claim 40, wherein each annular member has a predefined thickness, said predefined thickness being generally within the range of 0.012–0.015 inches.

48. The connector of claim 40, further comprising pairs of walls disposed between said annular members, each pair of walls including a moveable wall and a static wall.

49. The connector of claim 48, wherein each moveable wall is disposed at a first predetermined angle with respect to an annular member while each static wall is disposed at a second predetermined angle with respect to an annular member when said obround body is in an extended state, said first angle being substantially greater than said second angle when said obround body is in an extended state.

50. The connector of claim 48, wherein each static wall is substantially greater in length than each moveable wall.

51. The connector of claim 40, wherein a predetermined number of said annular members include a reinforcing bead having a predetermined radius of curvature.

* * * * *